US006227641B1

(12) United States Patent
Nishikori et al.

(10) Patent No.: US 6,227,641 B1
(45) Date of Patent: May 8, 2001

(54) INK JET PRINTING SYSTEM HAVING HEAT KEEPING FUNCTION

(75) Inventors: Hitoshi Nishikori; Nobuyuki Kuwabara, both of Kawasaki; Noribumi Koitabashi, Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/885,179

(22) Filed: Jun. 30, 1997

(30) Foreign Application Priority Data

Jul. 2, 1996 (JP) ..... 8-172121

(51) Int. Cl.[7] ..... B41J 2/01
(52) U.S. Cl. ..... 347/17; 347/60
(58) Field of Search ..... 347/60, 57, 14, 347/17, 58

(56) References Cited

U.S. PATENT DOCUMENTS

| | | | | |
|---|---|---|---|---|
| 4,313,124 | | 1/1982 | Hara . | |
| 4,345,262 | | 8/1982 | Shirato et al. . | |
| 4,459,600 | | 7/1984 | Sato et al. . | |
| 4,463,359 | | 7/1984 | Ayata et al. | 347/56 |
| 4,558,333 | | 12/1985 | Sugitani et al. . | |
| 4,608,577 | | 8/1986 | Hori . | |
| 4,712,172 | * | 12/1987 | Kiyohara | 347/60 |
| 4,723,129 | | 2/1988 | Endo et al. . | |
| 4,740,796 | | 4/1988 | Endo et al. . | |
| 4,791,435 | * | 12/1988 | Smith | 347/60 X |
| 5,107,276 | * | 4/1992 | Kneezel | 347/60 |
| 5,148,192 | | 9/1992 | Izumida et al. . | |
| 5,166,699 | | 11/1992 | Yano et al. . | |
| 5,367,325 | | 11/1994 | Yano et al. . | |
| 5,371,528 | | 12/1994 | Izumida et al. . | |
| 5,427,611 | * | 6/1995 | Shirota | 347/99 X |
| 5,451,988 | * | 9/1995 | Ono | 347/60 X |
| 5,565,899 | | 10/1996 | Sugimoto et al. . | |
| 5,625,384 | | 4/1997 | Numata et al. . | |
| 5,689,292 | * | 11/1997 | Suzuki | 347/60 X |
| 5,745,132 | | 4/1998 | Hirabayashi et al. | 347/14 |
| 5,867,200 | * | 2/1999 | Tajima | 347/60 X |

FOREIGN PATENT DOCUMENTS

| | | | |
|---|---|---|---|
| 54-56847 | 5/1979 | (JP) | B41M/5/26 |
| 54-59139 | 5/1979 | (JP) . | |
| 54-59936 | 5/1979 | (JP) . | |
| 55-27281 | 2/1980 | (JP) . | |
| 55-27282 | 2/1980 | (JP) . | |
| 59-123670 | 7/1984 | (JP) | B41J/3/04 |
| 59-138461 | 8/1984 | (JP) | B41J/3/04 |
| 60-71260 | 4/1985 | (JP) | B41J/3/04 |
| 4-10940 | 1/1992 | (JP) | B41J/2/05 |
| 4-10941 | 1/1992 | (JP) | B41J/2/05 |
| 4-10942 | 1/1992 | (JP) | B41J/2/05 |

* cited by examiner

*Primary Examiner*—Joan Pendegrass
(74) *Attorney, Agent, or Firm*—Fitzpatrick, Cella, Harper & Scinto

(57) ABSTRACT

An ink jet head supplies an ejection heater arranged in a liquid path with a driving signal to impart heat energy to ink to thereby generate a bubble therein. The bubble is caused to communicated with the atmospheric air, and ink is ejected through an ejection outlet. A heat keeping circuit supplies the ejection heater with a driving pulse having a time width insufficient for causing ink to be ejected during non-printing period in an appropriate duty corresponding to the head temperature condition, thereby causing the ejection heater to generate heat to effect heat keeping on the head, whereby a low-cost thermal ink jet printing system is provided which does not entail a variation in ejection amount during printing.

29 Claims, 18 Drawing Sheets

FIG. 5

| ENVIRONMENTAL TEMPERATURE [ °C ] | TARGET HEATING TEMPERATURE [ °C ] |
|---|---|
| 25 ~ | 25 |
| 20 ~ 25 | 28 |
| 15 ~ 20 | 32 |
| 10 ~ 15 | 35 |
| ~ 10 | 40 |

FIG. 7

| ΔT [ °C ] | HEATING TIME [sec] |
|---|---|
| 15 ~ | 7 |
| 8 ~ 15 | 3 |
| 0 ~ 8 | 1 |
| ~ 0 | 0 |

FIG. 9

| ΔT [ °C ] | HEAT KEEPING DUTY |
|---|---|
| 15 ~ | 100 % |
| 10 ~ 15 | 75 % |
| 5 ~ 10 | 50 % |
| 0 ~ 5 | 25 % |
| ~ 0 | 0 % |

FIG. 15

| CARRIAGE MOVEMENT AMOUNT / ΔT (°C) | A | B | C | PRINTING START POSITION |
|---|---|---|---|---|
| 15 ~ | 100 % | 100 % | 100 % | 50 % |
| 10 ~ 15 | 75 % | 100 % | 100 % | 50 % |
| 5 ~ 10 | 50 % | 75 % | 100 % | 25 % |
| 0 ~ 5 | 25 % | 25 % | 25 % | 25 % |
| 15 ~ 0 | 0 % | 0 % | 0 % | 0 % |

FIG. 19

| CARRIAGE POSITION / ΔT [°C] | A | B | C | PRINTING START POSITION |
|---|---|---|---|---|
| 15 ~ | 100 % | 100 % | 100 % | 50 % |
| 10 ~ 15 | 75 % | 100 % | 100 % | 50 % |
| 5 ~ 10 | 50 % | 75 % | 100 % | 25 % |
| 0 ~ 5 | 25 % | 25 % | 25 % | 25 % |
| 15 ~ 0 | 0 % | 0 % | 0 % | 0 % |

INK JET PRINTING SYSTEM HAVING HEAT KEEPING FUNCTION

BACKGROUND OF THE INVENTION

1. Field of the Invention

The present invention relates to a bubble-through-type ink jet printing apparatus and to a heat keeping control method for the apparatus.

2. Description of the Related Art

An ink jet printing apparatus, in which ink is ejected through an ejection outlet as minute droplets to print character information, such as letters, numbers and symbols, and pictorial information, such as figures and patterns, has excellent merits as a high-definition and high speed image printing means. In particular, a method using a bubble (air bubble) generated by an electro-thermal transducer (hereinafter referred to as a "heater"), i.e., a so-called thermal ink jet recording system (which is disclosed, for example, in Japanese Patent Publications No. 61-59911~59914), is characterized in that it easily allows a reduction in apparatus size and an increase in image density.

Further, the thermal ink jet recording system has the following features: by energizing the heater for ejecting ink droplets (hereinafter referred to as the "ejection heater"), heat energy is generated to thereby generate a bubble in the ink. The growth of the bubble thus generated is greatly influenced by the temperature of the ink around it. At the interface between the bubble and the ink, two processes are going on: the process in which gas-phase molecules in the bubble migrate into the ink and the process in which liquid-phase molecules in the ink migrate into the bubble. The temperature of the ink around the bubble influences the latter process. When the temperature of the ink is high, a large amount of molecules migrate into the bubble, with the result that the bubble grows to a relatively large extent. Conversely, when the temperature of the ink is low, the amount of molecules migrating from the ink into the bubble is relatively small, so that the size of the bubble is smaller as compared to that in the case in which the temperature of the ink is high. The size of the bubble reflects the amount of ink pushed out by it (hereinafter referred to as the "ejection amount"). Thus, in a thermal ink jet recording head, the ejection amount is greatly influenced by the temperature of the ink portion in the vicinity of the heater. When the ink temperature is high, the ejection amount is large, and when the ink temperature is low, the ejection amount is small.

Generally speaking, in a low-temperature environment, the ink used in ink jet printing undergoes an increase in viscosity (hereinafter referred to as "thickening"), so that the volume of the ink ejected from the printing head decreases or the ejection of the ink cannot be smoothly effected. Further, in the above-described thermal ink jet recording system, the temperature of the ink influences the growth of the bubble generated, and the volume of the bubble decreases, thereby decreasing the ejection amount or making it difficult for the ink to be smoothly ejected.

Further, when the ejection of ink is not effected, the volatile ingredient of the ink is evaporated, so that the thickening of the ink occurs to a particular degree, thereby making it difficult for the ink to be ejected in the normal fashion. As stated above, in a low-temperature environment, the ejection becomes more difficult; in extreme cases, the ejection becomes impossible.

In conventional printing apparatuses, the printing head is kept warm in a low-temperature environment before or during the printing operation to thereby cope with such defective ejection or the impossibility of ejection, thereby reducing the viscosity of the ink and adjusting the condition such that the bubble can be easily allowed to grow.

There are two principal methods of keeping the printing head warm: according to one method, the ink droplet ejection heater is driven to generate heat in the printing head. According to the other method, the printing head is equipped with a heater for keeping it warm (hereinafter referred to as the "heat keeping heater").

The conventional thermal ink jet recording heads and the conventional heat keeping methods have the following problem: when the ink is heated to be kept warm by using the ejection heater, the temperature of the ink portion in the vicinity of the heater becomes too high as compared to the temperature of the other ink portion. As a result, after the start of the ejection of ink droplets, the ejection amount is large while the ink portion at high temperature stays in the vicinity of the heater, but, when that ink portion has been ejected and an ink portion at a relatively low temperature is supplied, the ejection amount decreases, which means that the ejection amount is not stable.

When a heat keeping heater is used, the heat keeping heater is arranged at some distance from the ejection heater, and the ink is heated by the heat conducted from the heat keeping heater, so that there is no concern that a particular ink portion will be heated, thereby making it possible to avoid the above-mentioned problem. However, this method has a problem in that it involves an increase in cost with respect to the printing head or the apparatus since it requires the preparation of the heat keeping heater, the provision of the wiring for the heat keeping heater, etc.

Several control methods are available when performing printing while keeping the printing head and the ink at a temperature not lower than a certain temperature.

In one method, the printing head is kept warm before starting the printing (or during non-printing period) and no heat keeping is effected during printing. In this method, the temperature of the printing head is gradually lowered during printing when the printing duty is low, with the result that the ejection amount gradually decreases. This is not much of a problem when it is characters that are to be printed. However, in the case of the printing of color graphics or the like, the change in ejection amount will lead to an acute change in tinge, so that this is not permissible in a printing apparatus required to perform color development control.

According to a technique, the following measure is taken to cope with the change in ejection amount due to the temperature of the printing head: the signal to be applied to the ejection heater consists of a plurality of pulses, and, before the main pulse for actually ejecting ink droplets from the printing head is applied, a short pulse (pre-pulse) having such an energy level as will not cause a bubble to be generated in the ink is applied to heat the ink portion in the vicinity of the ejection heater to thereby control the ejection amount. However, there is a limit to the range in which this control is effective. When the printing head is driven at a high frequency, there is no time left for applying the pre-pulse before the application of the main pulse, which means the driving frequency for the printing head is limited.

To cope with the problem of the temperature of the printing head being lowered during low duty printing in a low-temperature environment, there is a technique available according to which an ejection heater which is not used for printing or the heat keeping heater is used even during printing to thereby keep the printing head warm. However, when the heater for heat keeping is driven simultaneously with the driving of the ejection heater, the consumption of power in the printing head during printing increases, so that it is necessary to install a power source device having a larger current capacity. A considerable increase in cost would be unavoidable if a power source device with a large current capacity were employed.

Further, apart from the power source device, the heat keeping control during printing may be effected independently of the driving signal for printing. In that case, it is necessary to provide a flexible cable for transmitting signals from the printing apparatus body to the printing head, and wiring on the chip incorporating the heater. Further, also when a driving signal for heat keeping is prepared by using a gate array provided on the chip to effect heat keeping during printing by using an ejection heater not being used for printing, it is necessary to provide wiring for that purpose on the chip, so that the chip area increases. For example, to effect heat keeping control from the printing apparatus body, it is necessary to provide a wire in a flexible cable for the transmission, resulting in an increase in cost. Further, when a heater and the requisite wiring are prepared on a silicon wafer by semiconductor process, the number of chips that can be prepared on one wafer is small when the area of the chip to incorporate the heater, etc. is large. Further, the proportion of the number of chips defectively produced due to dust, etc. increases, resulting in a reduction in production yield.

SUMMARY OF THE INVENTION

It is an object of the present invention to provide an ink jet printing apparatus and a control method in which no such variation in ejection amount during printing as mentioned above is involved while heat keeping control is performed on the printing head, thereby achieving a reduction in production cost and running cost.

To achieve the above object, there is provided an ink jet printing apparatus comprising: an ink jet printing head in which a driving signal is supplied to energy imparting means arranged in the liquid path to impart heat energy to ink to thereby form a bubble therein and in which the above-mentioned bubble communicates with the atmospheric air and ink is ejected from an ejection outlet to thereby effect printing; and control means which supplies the above-mentioned energy imparting means with a heating signal to generate heat energy that is not large enough to cause ink to be ejected to thereby effect heat keeping control on the above-mentioned ink jet printing head, whereby there is provided a low-cost thermal ink jet printing system which does not entail the above-mentioned variation in ejection amount during printing although heat keeping control is effected on the printing head.

Further, there is provided an ink jet printing apparatus comprising: an ink jet printing head in which a driving signal is supplied to energy imparting means arranged in the liquid path to impart heat energy to ink to thereby form a bubble therein and in which the above-mentioned bubble communicates with the atmospheric air and ink is ejected from an ejection outlet to thereby effect printing; heat keeping means for keeping the above-mentioned printing head warm; and control means which does not control the above-mentioned heat keeping means during a predetermined continuous printing operation and which controls the above-mentioned heat keeping means before the starting of a printing operation such that the above-mentioned ink jet printing head is kept at a temperature not lower than a predetermined temperature during the printing operation, whereby there is provided a high-definition, highly reliably and low-cost thermal ink jet printing system which does not entail the above-mentioned variation in ejection amount during printing.

Further, there is provided a heat keeping control method for an ink jet head comprising the steps of: providing an ink jet printing head in which a driving signal is supplied to energy imparting means arranged in the liquid path to impart heat energy to ink to thereby form a bubble therein and in which the above-mentioned bubble communicates with the atmospheric air and ink is ejected from an ejection outlet to thereby effect printing; and supplying the above-mentioned energy imparting means with a heating signal to generate heat energy that is not large enough to cause ink to be ejected to thereby effect heat keeping control on the above-mentioned ink jet printing head Further, there is provided a heat keeping control method for an ink jet head comprising the steps of: providing an ink jet printing head in which a driving signal is supplied to energy imparting means arranged in the liquid path to impart heat energy to ink to thereby form a bubble therein and in which the above-mentioned bubble communicates with the atmospheric air and ink is ejected from an ejection outlet to thereby effect printing; providing heat keeping means for keeping the above-mentioned printing head warm; and suspending the control of the above-mentioned heat keeping means during a predetermined continuous printing operation and controlling the above-mentioned heat keeping means before the starting of a printing operation so that the above-mentioned ink jet printing head is kept at a temperature not lower than a predetermined temperature during the printing operation.

BRIEF DESCRIPTION OF THE DRAWINGS

FIG. 5 is a diagram illustrating an example of a table for determining target heating temperature from ambient temperature in the first embodiment;

FIG. 7 is a diagram illustrating an example of a table for determining the short pulse application time with respect to the difference ($\Delta T$) between the target heating temperature and the head temperature;

FIG. 9 is a diagram illustrating an example of a table for selecting heat keeping condition in the non-printing state from $\Delta T$ in the first embodiment;

FIG. 15 is a diagram illustrating an example of a table for selecting heat keeping control condition by carriage movement distance and ΔT in the second embodiment;

FIG. 19 is a schematic diagram showing an example of a table for selecting heat keeping control condition by carriage position and ΔT in the third embodiment.

DESCRIPTION OF THE PREFERRED EMBODIMENTS

Figure 1:
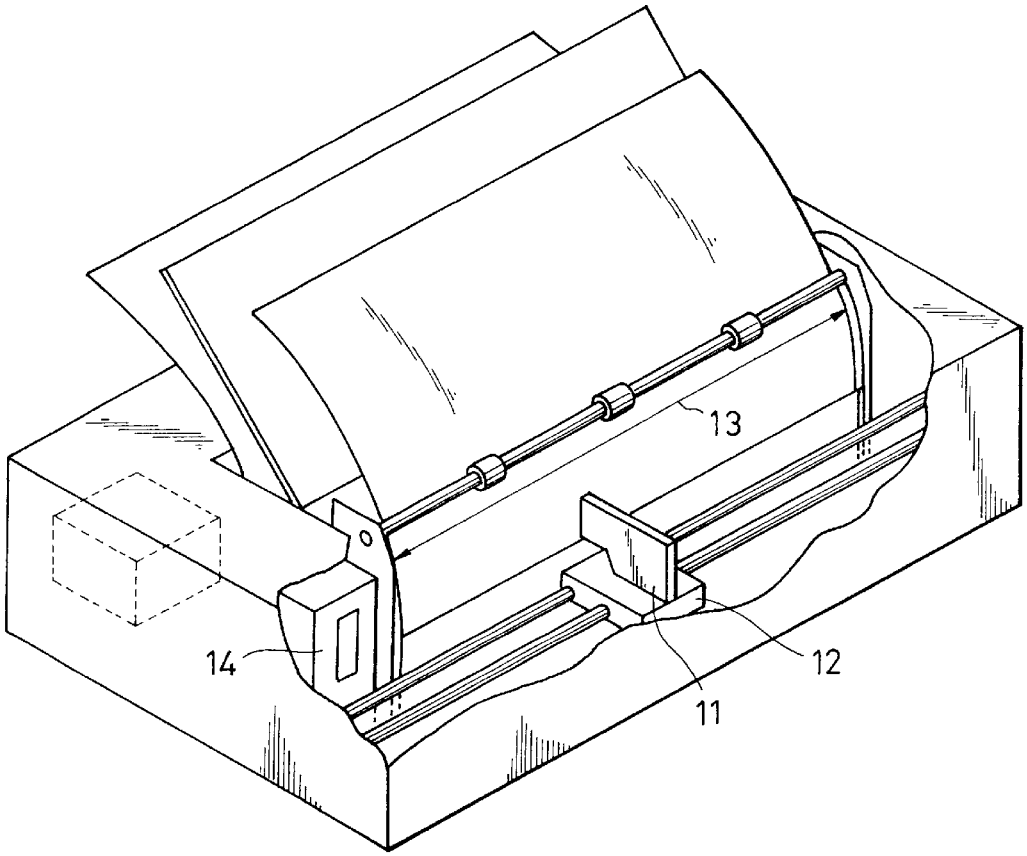
FIG. 1 is a schematic perspective view showing the construction of an ink jet printing apparatus used in a first embodiment of the present invention.

The present invention will now be described in detail with reference to the drawings

First Embodiment

[Outline]

In the first embodiment, described below, heat keeping control is effected for the purpose of keeping the printing head at a temperature not lower than 25° C. during printing.

In this embodiment, heat keeping control is effected by applying a short pulse with a small width which imparts an energy not large enough to generate a bubble in the ejection heater. Before starting printing, the ambient temperature is detected by a temperature sensor provided in the printing apparatus body (This temperature sensor, which monitors the ambient temperature of the printing head, is provided in the printing apparatus at a position which is near the printing head and where the influence of the power source device is negligible) to determine a target heating temperature.

Here, the term "target temperature" will be explained. In the printing apparatus used in this embodiment, the printing head is mounted on a carriage, and printing is performed while performing scanning in a direction perpendicular to the direction in which the printing medium, consisting of paper, film, cloth or the like, is fed. In the scanning with the printing head for printing, energy is imparted to the printing head prior to the starting of the scanning in order that the temperature of the printing head may be kept at a temperature not lower than a predetermined temperature during the scanning even when the printing duty is low and there is scarcely any temperature rise in the printing head due to the printing. The target heating temperature is the temperature which is to be attained in the heating. During printing operation, no heat keeping is effected on the printing head.

In the heat keeping control of this embodiment, a short pulse is applied to the ejection heater before the printing of one page is started for a predetermined period of time corresponding to a value obtained by subtracting from the above-mentioned target heating temperature a temperature monitored by a temperature sensor provided on the head (hereinafter referred to as the "head temperature").

When a predetermined continuous printing, e.g., the scanning of one line is completed, the duty of the short pulse to be applied to the ejection heater for the purpose of heat keeping of the printing head is determined on the basis of head temperature information, for example, each 200 msec. until the scanning for the printing of the next line is started.

When printing cannot be performed although the printing head is at the printing start position due, for example, to the transmission of printing data of the host computer, the developing of data, etc., the heat keeping operation is stopped 5 seconds after the printing head has reached the printing start position. When the printing is started again, the heat keeping processing is executed on the printing head as in the case of the starting of the printing of one page.

[Printing Apparatus Used in This Embodiment]

FIG. 1 is a perspective view of the ink jet printing apparatus used in this embodiment. An ink jet head 11 is mounted on a carriage 12. When an ink jet head recovery operation is conducted, the carriage 12 moves to a position corresponding to a suction device 14, which is out of the printing area 13, and a predetermined operation is executed.

Figure 2:
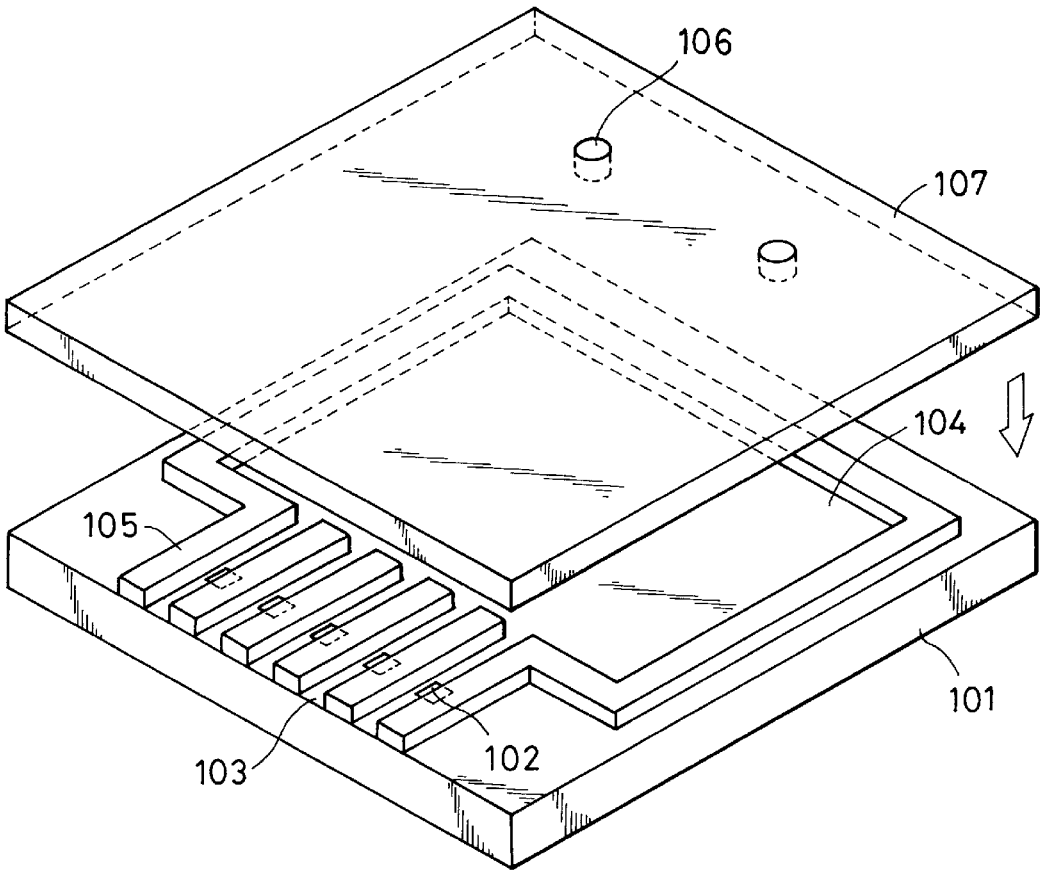
FIG. 2 is a schematic perspective view showing an example of the construction of the essential part of an ink jet head which is used in the apparatus of FIG. 1 and to which a bubble through ejection system is applicable.

FIG. 2 is a schematic diagram showing an example of the construction of the essential part of an ink jet head to which the bubble through ejection system (Japanese Patent Laid-Open No. 4-10940~10942, U.S. Application Ser. No. 07/692,935, filed Apr. 29, 1991, which is a parent case to U.S. Application Ser. No. 08/099,396, filed Jul. 30, 1993, and U.S. Application Ser. No. 09/615,933, filed Jul. 13, 2000 used in this embodiment is applicable. As shown in FIG. 2, on a substrate 101, there are formed a predetermined number of heaters 102 and electrode wiring (not shown) for transmitting electric signals to these heaters 102. A wall 105 is provided in order to form liquid paths 103 at predetermined intervals on these heaters 102 and to form a common liquid chamber 104 communicating with these liquid paths 103. A top plate 107 having ink supply inlets 106 is joined to the wall 105, whereby an ink jet head is formed. That is, the portion surrounded by the wall 105, the substrate 101 and the top plate 107 constitutes the liquid paths 103, and ink is supplied to the liquid paths 103 by way of the supply inlets 106 and the common liquid chamber 104. Ejection signals are applied to the heaters 102 through the electrode wiring to generate bubbles on the heaters 102 to thereby eject liquid droplets from ejection outlets at the forward end of the liquid paths. Further, the substrate 101 has a built-in temperature sensor (not shown) and the temperature of the printing head can be monitored by the output of this sensor.

The driving of the printing head is effected by means of a single driving pulse to facilitate high-speed drive. When the driving is effected by means of a plurality of driving pulses and the ink portion near the ejection heater is heated by an earlier pulse, effecting the ejection by a later pulse, it is possible to generate a relatively large bubble with a small amount of energy as compared with the case in which the driving is effected by means of a single pulse. However, as stated above, when the driving of the printing head is effected at high speed, the time that can be used for the driving of each heater is reduced, which means the driving by a plurality of pulses is disadvantageous. However, when the driving is effected by means of a single pulse, it is rather difficult for the bubble to grow, so that, to obtain a bubble having the same size as when a plurality of driving pulses are used, it is desirable to enlarge the heater size.

FIGS. 3A through 3F are diagrams for illustrating the ejection operation of the ink jet head shown in FIG. 2 by the bubble through ejection system. Numeral 21 indicates ink in the liquid path 103; numeral 23 indicates an ejection outlet at one end of the liquid path 103; numeral 25 indicates the surface of the head in which the ejection outlet is formed (ejection outlet surface); numeral 26 indicates the meniscus; and numeral 27 indicates the bubble.

Figure 3A:
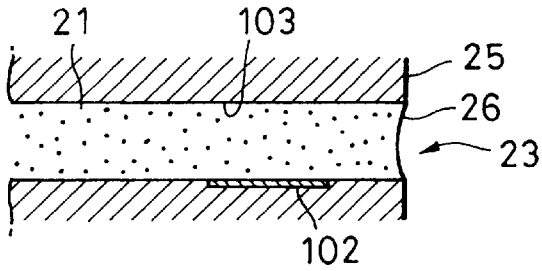
FIGS. 3A through 3F are diagrams illustrating an ejecting operation of the ink jet head shown in FIG. 2 according to the bubble through ejection system.
Figure 3B:
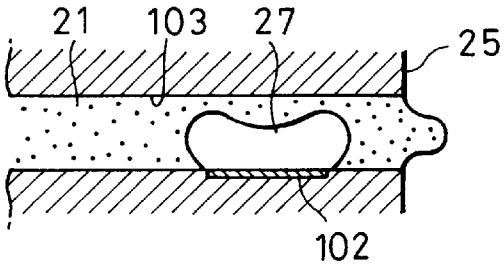
Figure 3C:
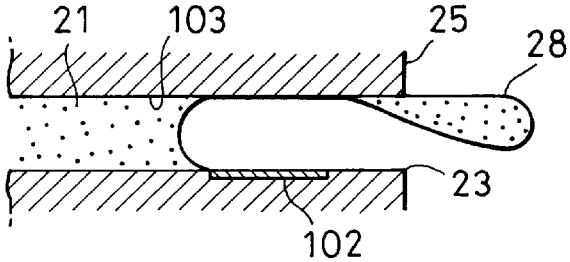
Figure 3D:
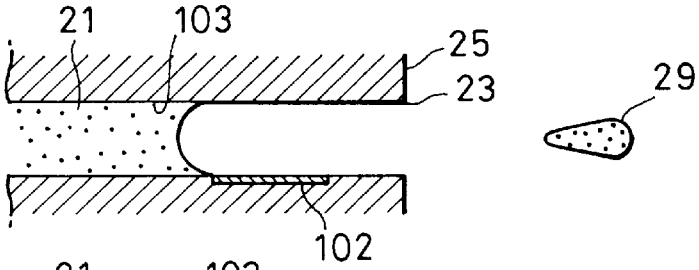
Figure 3E:
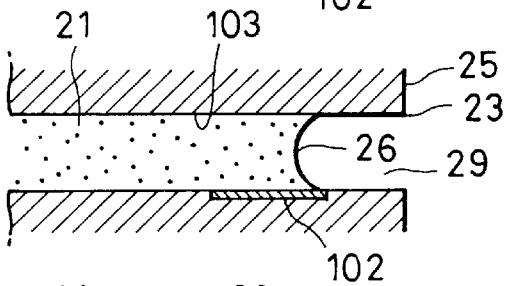
Figure 3F:
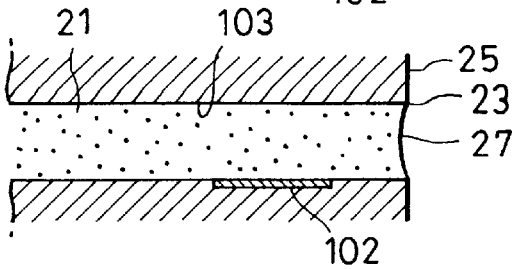

FIG. 3A shows the condition prior to the generation of the bubble. In this condition, the meniscus 26 of the ink 21 is substantially in conformity with the plane of the ejection outlet surface 25. When in this condition the ink portion 21 near the heater 24 is heated by instantaneously applying an ejection signal to the heater 102, the bubble 27 is generated and starts to expand (FIG. 3B). The bubble 27 continues to expand, until it communicates with the atmospheric air through the ejection outlet 23 (FIG. 3C). At this time, the ink portion 28 which has been on the ejection outlet 23 side with respect to the bubble 27 is pushed forward by the momentum imparted from the bubble 27 (FIG. 3C). Then, the ink portion 28 is turned into an independent liquid droplet 29 and ejected toward the printing medium, such as paper (FIG. 3D). At this time, the meniscus 26 is retracted inwardly from the ejection outlet 23 to generate a void in front of it (FIG. 3E). However, this void is filled with a new portion of ink due to the surface tension of the ink 21, the wettability of the inner wall of the liquid path 103 with which the ink is in contact, etc, and the condition before the ejection is restored (FIG. 3F).

Figure 4:
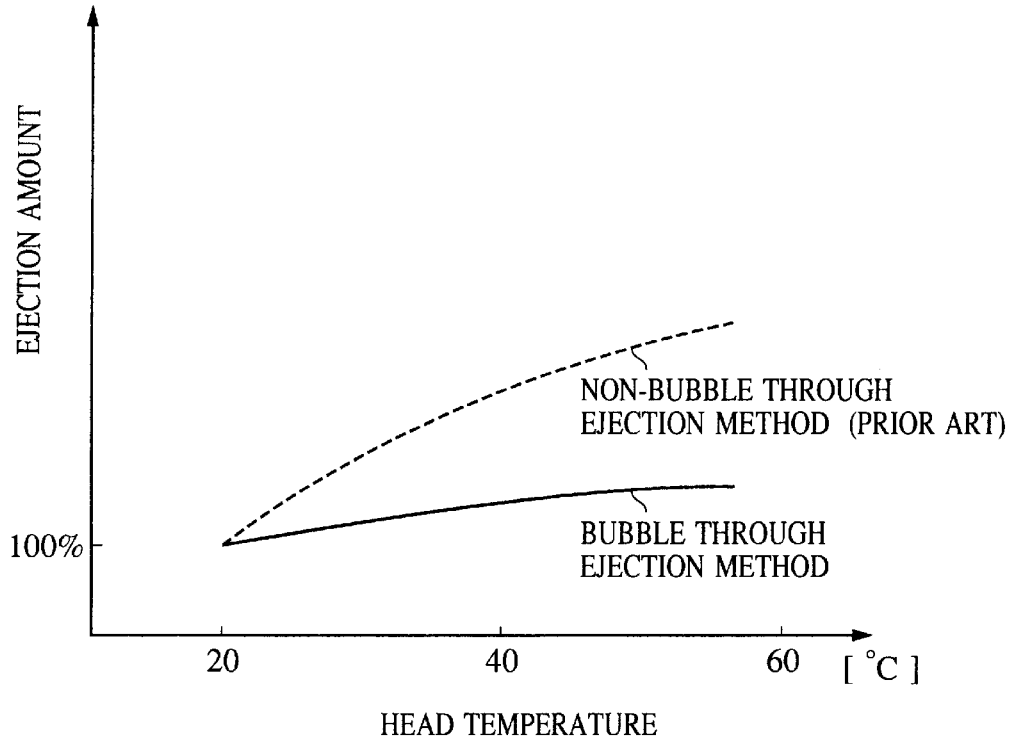
FIG. 4 is a schematic diagram showing the difference in the degree to which ejection amount depends upon head temperature between the case in which the bubble through ejection system is used in the printing head of the first embodiment and the case in which the bubble through ejection system is not used in a conventional printing head.

FIG. 4 is a schematic diagram showing the difference in the degree to which ejection amount depends upon the head temperature between the case in which the bubble through ejection system is used in the printing head of this embodiment and the case in which the bubble through ejection system is not used in a conventional printing head. This difference in the dependence on temperature is due to the adoption of the bubble through ejection system. In a printing head of the thermal ink jet type, heat is generated by an ejection heater to generate a bubble to thereby eject ink. When the head temperature increases and the temperature of the ink portion near the ejection heater rises, the size of the bubble is increased. In a printing head adopting the conventional ejection method, as the size of the bubble increases, the amount of ink pushed and ejected from the printing head also increases. In the bubble through system, when all the ink portion from the ejection heater to the ejection outlet has been ejected, the amount of ejected ink does not increase no matter how the bubble may increase in size, so that the degree to which the ejection amount depends upon the temperature is reduced.

When the printing head is left to stand for more than a predetermined period of time without effecting ejection, the ink portion near the ejection outlet undergoes an increase in viscosity or concentration as a result of the evaporation of the volatile ingredient of the ink. In view of this, in the apparatus of this embodiment, in order to remove this ink portion, ink droplets are ejected from the printing head in a predetermined number and with a predetermined timing toward an ink receiver (not shown) provided in the vicinity of the suction device 14 (hereinafter, this ejection operation will be referred to as the "preliminary ejection").

[Setting of the Target Heating Temperature]

At the start of the printing of each page, the ambient temperature is detected by a temperature sensor provided on the printing apparatus body (This temperature sensor is provided at a position which is inside the printing apparatus and near the printing head and at which the influence of the power source device is negligible, and serves to monitor the ambient temperature of the printing head) and the target heating temperature is determined.

FIG. 5 illustrates an example of a table for determining the target heating temperature from the ambient temperature. The setting of the value with reference to this table is effected prior to the start of the printing of each page, whereby it is possible to adapt the apparatus to a case in which the temperature in the printing apparatus increases to such a degree as to eliminate the need to effect heat keeping on the printing head.

[Heat Keeping Control]

In this embodiment, the heat keeping control is effected in correspondence with a value obtained by subtracting from the target heating temperature the temperature as monitored by the temperature sensor provided on the head (the head temperature) (Hereinafter, this value will be referred to as $\Delta T$). In this embodiment, the driving of the ejection heater for effecting heat keeping control is effected at a driving frequency, for example, of 40 kHz, using a driving pulse (a short pulse) which is not long enough to cause the ink portion near the heater to boil. As long as ink is not ejected, the heating signal for heat keeping may be such as to cause a bubble to be generated on the heater.

Figure 6:
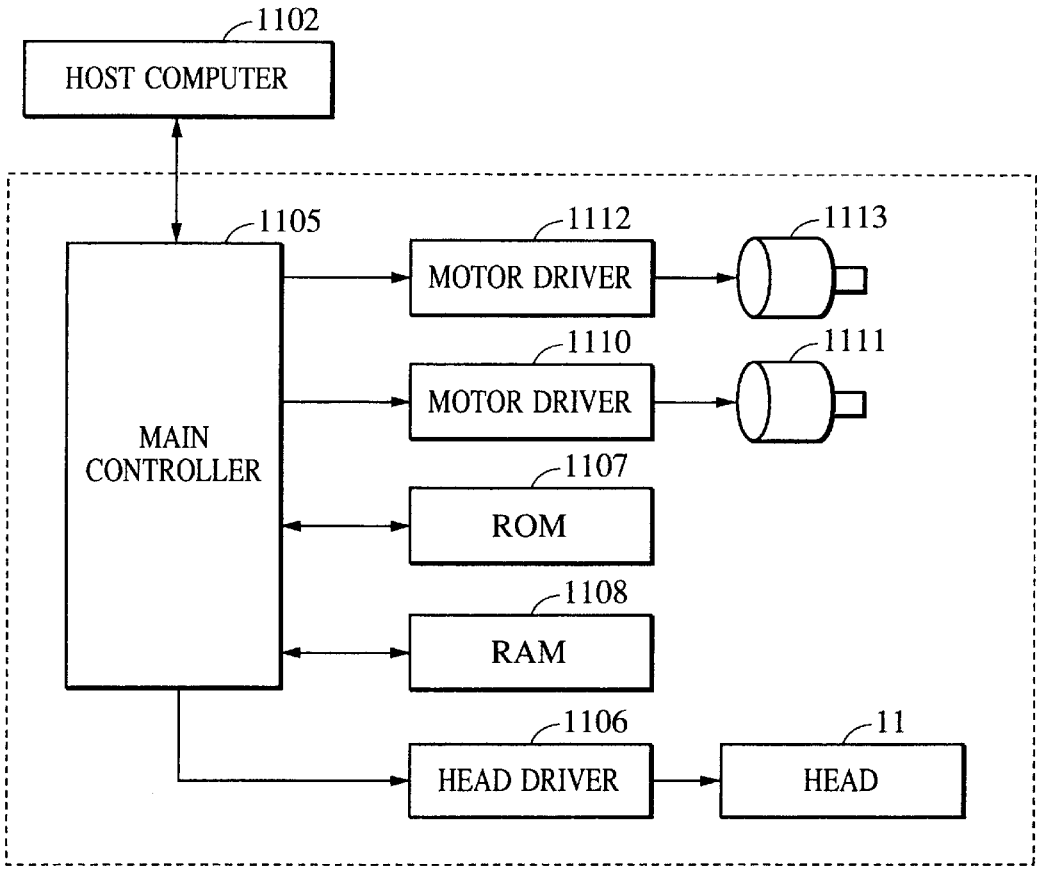
FIG. 6 is a schematic block diagram showing the construction of the control system of the recording apparatus of the first embodiment.

FIG. 6 is a schematic block diagram showing the construction of the control system of the recording apparatus of this embodiment. In the drawing, numeral 1105 indicates a main controller, which controls the operation of the entire printing apparatus and receives printing data transmitted from a host computer 1102 to develop it, effecting control operations, such as the printing of the data on a printing medium such as paper. This main controller 1105 is equipped with a CPU in the form of a microprocessor, etc., and is connected to an ROM 1107 storing a control program for the CPU (the program corresponding to the processing procedures described with reference to FIGS. 10 and 11, etc.), a table for temperature control and other requisite fixed data, an RAM 1108 which is used as the work area of the CPU and which is used for temporarily storing various items of data, etc.

Numeral 1113 indicates a line feed motor for feeding recording paper or the like, which constitutes the printing medium. Numeral 1111 indicates a carriage motor for the scanning of the carriage 12 on which the head is mounted. Numerals 1110 and 1112 indicate motor drivers, to each of which a control signal from the main controller 1105 is input so as to drive the corresponding motor at an appropriate time. Numeral 1106 indicates a head driver, which drives the printing head 11 in accordance with the printing data stored in the RAM 1108 to thereby perform printing operation.

In this control system, first, prior to the start of printing, the short pulse application to the ejection heater is effected at time intervals corresponding to the above-mentioned $\Delta T$.

Figure 8A:
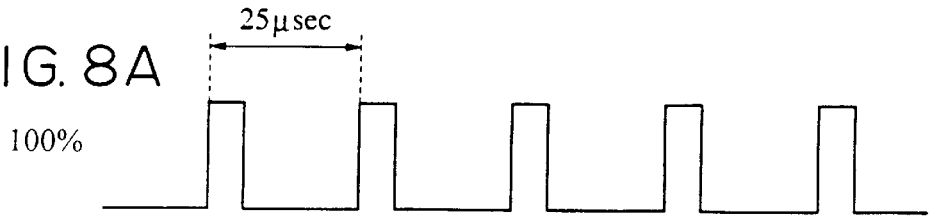
FIGS. 8A through 8D are diagrams illustrating examples of the waveform of a driving pulse for performing heat keeping control in accordance with $\Delta T$.
Figure 8B:
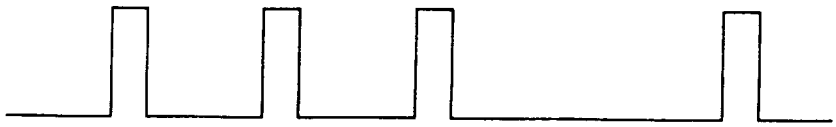
Figure 8C:
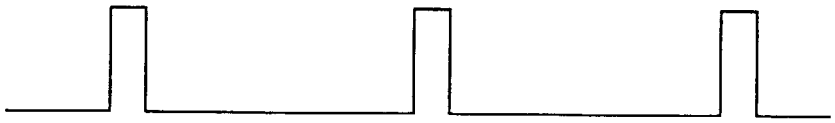

FIG. 7 illustrates an example of a table for determining the short pulse application time with respect to $\Delta T$; and FIG. 8A illustrates the waveform of a driving pulse applied on that occasion. This heating, which is conducted for the purpose of heating the components incorporating the heaters, is conducted also for the purpose of heating the heat dissipation channel for dissipating the heat generated in the printing head, for example, the heat sink. By, for example, effecting the heat keeping before print scanning, this makes it possible to delay the lowering of the temperature of the printing head whose temperature has been raised.

After the completion of the printing of one line, while the carriage on which the printing head is mounted is moving toward the next printing start position with the printing head not conducting printing operation or while the printing medium is being fed, the head temperature is detected and heat keeping control is effected in accordance with ΔT.

Figure 10:
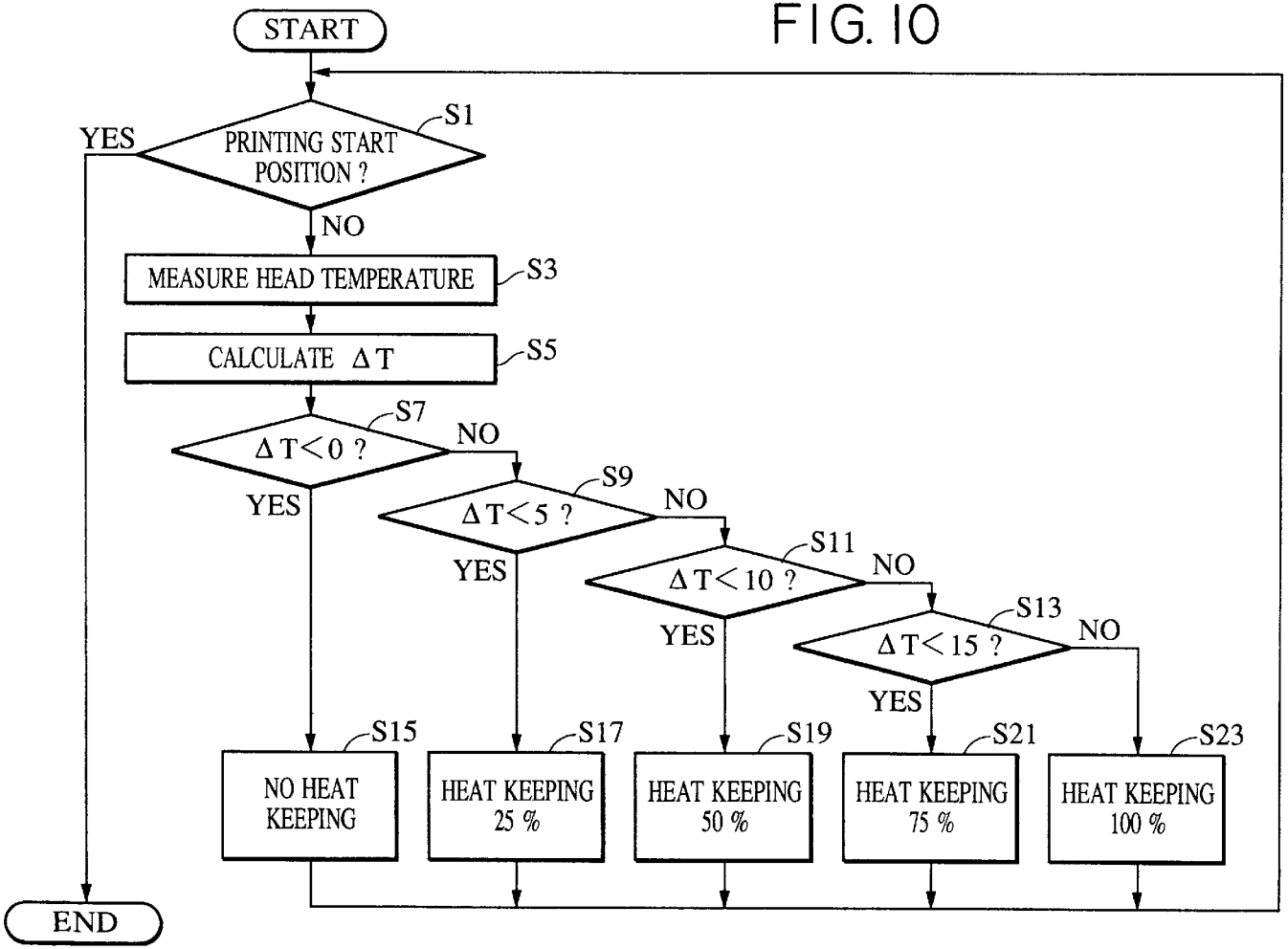
FIG. 10 is a flowchart showing an operational flow in heat keeping control in the first embodiment.

FIG. 10 shows an example of the heat keeping control procedures executed after the completion of one main scanning printing until the printing head reaches the start position of the next main scanning printing. These procedures are started, for example, every 200 msec. First, it is made sure that the printing head has not reached the start position for the next main scanning printing yet (Step S1), and the head temperature is measured (Step S3). On the basis of the ΔT thereby calculated (Step S5), the driving pulse waveform of heat keeping control is varied in accordance with ΔT (Steps S7 through S13).

FIGS. 8A through 8D illustrate examples of the waveform of a driving pulse used in this control, and FIG. 9 illustrates an example of a table for selecting a driving pulse waveform in accordance with ΔT.

Figure 8D:
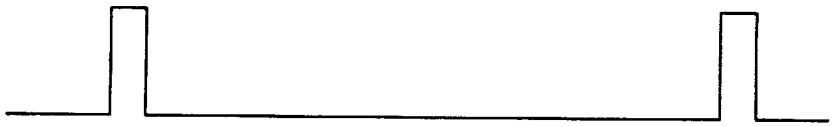

As shown in FIGS. 8A through 8D, in this embodiment, the driving at 40 kHz is 100% (FIG. 8A) in correspondence with ΔT, and, when ΔT is not lower than 15° C., this waveform is adopted (Step S23). In other cases, the driving pulses are appropriately thinned out, whereby a driving pulse for heat keeping control of 75% imparted energy is formed when ΔT is not lower than 10° C. and lower than 15° C. (FIG. 8B, Step S21); a driving pulse for heat keeping control of 50% imparted energy is formed when ΔT is not lower than 5° C. and lower than 10° C. (FIG. 8C, Step S19); and a driving pulse for heat keeping control of 25% imparted energy is formed when ΔT is not lower than 0° C. and lower than 5° C. (FIG. 8D, Step S17). When ΔT is lower than 0° C., no heat keeping control is effected (Step S15).

Due to this control, it is possible to perform printing while maintaining the temperature of the printing head in the temperature range (not lower than 25° C. in this embodiment) in which printing head operation can be conducted with high reliability even in the case in which the printing duty is low and in which there is scarcely any temperature rise as a result of the driving of the printing head for printing.

In some cases, even when the printing head has reached the printing start position, the preparation for the printing is not completed yet and the printing cannot be started, as in the case in which the host computer 1102 is conducting data transfer to the printing apparatus for the printing of the next line.

Figure 11:
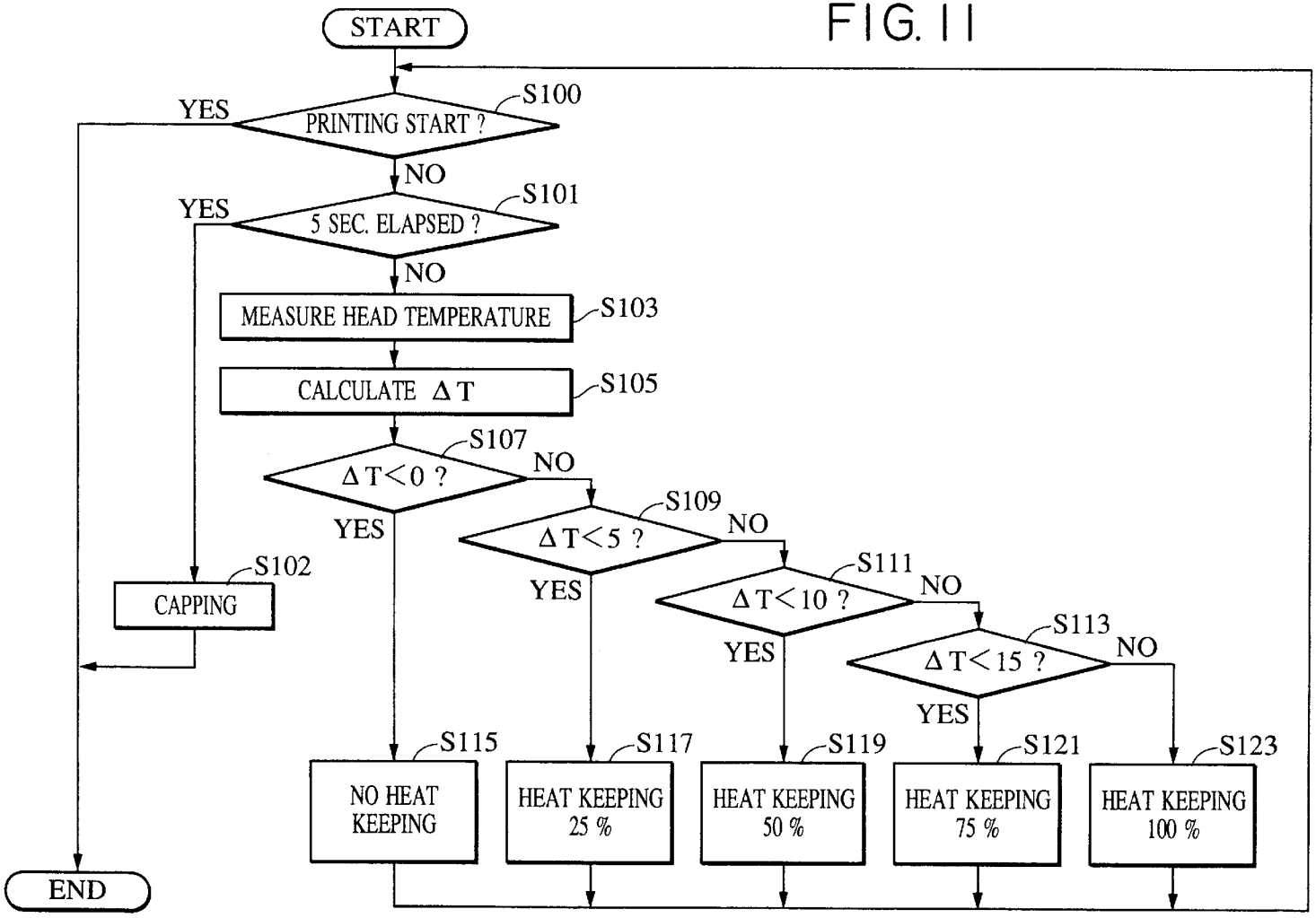
FIG. 11 is a flowchart showing an operational flow in heat keeping control in the first embodiment.

FIG. 11 is a flowchart showing an example of the heat keeping procedures to be taken in the case in which printing cannot be started even when the printing head has reached the start position for the next scanning printing, and the apparatus is held on standby for printing.

In the procedures, first, a judgment is made as to whether there is a printing start command signal or not (Step S100). When there is no such command, a judgment is made as to whether, for example, 5 seconds have elapsed or not after the printing start position has been reached (Step S101). For 5 minutes at the maximum, the above steps S3 through S23 and similar steps S103 through S123 are executed, for example, every 200 msec., and the apparatus is on standby for printing while continuing the heat keeping of the printing head. When printing cannot be started even when 5 minutes have elapsed after the apparatus has been brought into the printing standby state, the heat keeping for the printing head is stopped, and the carriage on which the printing head is mounted is restored to the home position, where capping is effected (Step S102).

The heat keeping processing is stopped when 5 minutes have elapsed in the printing standby state for the following reason: irrespective of whether the ambient temperature is low or not, when the ejection of ink from the printing head is not effected and no capping is conducted, the volatile ingredient of the ink evaporates from the ejection outlet of the printing head, with the result that the ink portion near the ejection outlet undergoes thickening or solidifies. Thus, when the apparatus is held on standby for printing as described above, a so-called preliminary ejection is effected at predetermined time intervals in order to remove the ink portion whose viscosity has increased. However, when such a condition is maintained for a long period of time, the amount of ink used for the preliminary ejection increases, and the consumption of ink is advanced, resulting in an increase in running cost. Further, the amount of ink ejected by preliminary ejection operation (waste ink) increases, and the capacity of the waste ink absorbing member, etc. in the printing apparatus for accommodating the waste ink increases. Thus, in this embodiment, the printing standby state is cancelled after a predetermined period of time has elapsed, and capping is performed.

In particular, when printing standby is effected in a low-temperature environment while performing heat keeping processing on the printing head, there occurs, in addition to the increase in the viscosity of the ink portion near the ejection outlet, releasing of the gas which has been dissolved in the ink as a result of the heating of the ink for a long period of time, thereby preventing the printing head from ejecting in the normal fashion. Thus, in this embodiment, the printing standby while effecting heat keeping is restricted to a predetermined period of time.

In this embodiment, the above-mentioned short pulse is applied to the ejection heater to effect heat keeping on the printing head, and printing is performed by the above-mentioned bubble through ejection method. The heat keeping of the head by the short pulse heating entails a locality in the ink temperature as compared to the case in which the heat keeping heater is used. However, since the bubble-through system is adopted, there is little variation in the ejection amount. Accordingly, it is possible to realize a low-cost printing system in which there is little variation in the ejection amount during printing even in a low-temperature environment, etc. without mounting a heater for the heat keeping of the printing head.

Further, in this embodiment, heat keeping control is executed exclusively during non-printing period, in which energy is imparted to the printing head until the printing is started, in order that the temperature of the printing head may be kept at a temperature not lower than a predetermined temperature without performing heat keeping on the printing head during printing even when the printing duty is low and there is little temperature rise in the printing head, and the printing is performed by the above-mentioned bubble-communication ejection method. When heat keeping is effected prior to the starting of printing, and no heat keeping is effected during printing, the head temperature is lowered during printing. However, since the bubble-through system is adopted, there is little variation in the ejection amount. In this way, no heat keeping is effected during printing, whereby it is possible to use a power source device of a smaller capacity. Further, it is possible to omit the circuit and control for heat keeping during printing. Thus, a low-cost printing system has been realized which provides a high level of reliability in a low temperature environment, etc. and which makes it possible to effect a printing that entails little variation in ejection amount during printing.

Further, in this embodiment, a short pulse is applied to the ejection heater to effect heat keeping prior to the printing start, so that there is no need to provide a heat keeping heater. Further, it is possible to use a power source with a small capacity.

In this embodiment, heat keeping control is effected during the period between the time one scanning printing is completed and the time the next printing is started. That is, heat keeping control is effected during the period in which the carriage moves to the next printing start position, the period in which the acceleration/deceleration of the carriage is effected, the period in which the paper feeding of the printing apparatus is effected, etc. However, this should not be construed restrictively. In accordance with the present invention, a large amount of energy is supplied in non-printing period and printing is effected by the bubble through ejection system, whereby a highly reliable printing involving little variation in ejection amount is effected and/or no heat keeping of the printing head is effected during printing, thereby achieving a reduction in cost. The heat keeping control of the printing head can be effected any time as long as the printing head is not performing printing operation. For example, it is possible to effect heat keeping on the printing head exclusively during the period in which the carriage moves to the next printing start position.

Further, while this embodiment has been described with reference to a printing apparatus in which a carriage with a printing head mounted thereon performs printing scanning in only one direction to effect printing, this should not be construed restrictively. In a printing apparatus in which printing scanning is effected in only one direction, the non-printing period is longer as compared to that in a printing apparatus in which printing scanning is effected in both directions, so that it is possible to secure sufficient time for effecting heat keeping on the printing head, and the printing head can be efficiently heated even when the speed at which printing data is transmitted to the printing apparatus and the speed at which data processing for the printing apparatus is performed are sufficiently high. However, when a long period of time is not required for the heat keeping of the printing head or in the case of such a printing apparatus, it is possible to perform printing scanning in both directions, effecting heat keeping control by utilizing other non-printing periods (e.g., data developing period).

Second Embodiment

[Outline]

In the second embodiment, as in the first embodiment, the printing head is kept at a temperature not lower than 25° C. during printing.

In this embodiment, as in the first embodiment, the above-mentioned short pulse is applied to the ejection heater to effect heat keeping control. Further, at the start of the printing of a page, the ambient temperature is detected by a temperature sensor similar to that of the first embodiment provided on the printing apparatus body to thereby determine the target heating temperature.

In the heat keeping control of this embodiment, the head temperature is detected at the completion of the printing of one line, and the calculated $\Delta T$ and the movement distance to the next line printing start position are detected, the heat keeping conditions being determined on the basis of these items of data. The application of a short pulse to the ejection heater for a predetermined period of time is effected before the printing of the page is started. While in the control of the first embodiment the conditions for the heat keeping control are selected every 200 msec., in this embodiment, the conditions for the heat keeping control are determined until the next line printing start position is reached after the completion of the scanning for one line printing.

When printing cannot be conducted although the printing head is at the printing start position due, for example, to the printing data transmission of the host computer, data developing, etc., heat keeping control with varied driving conditions is effected until printing is started. However, the heat keeping is stopped 5 seconds after the arrival of the printing head at the printing start position. When printing is started again, heat keeping processing is conducted on the printing head as in the case of the starting of page printing.

[Printing Apparatus Used in this Embodiment]

Next, the ink jet printing apparatus used in the second embodiment will be described. As in the first embodiment, the printing apparatus body and the control system may be the same as those shown in FIGS. 1 through 6. However, the construction of the printing head is different.

Figure 12:
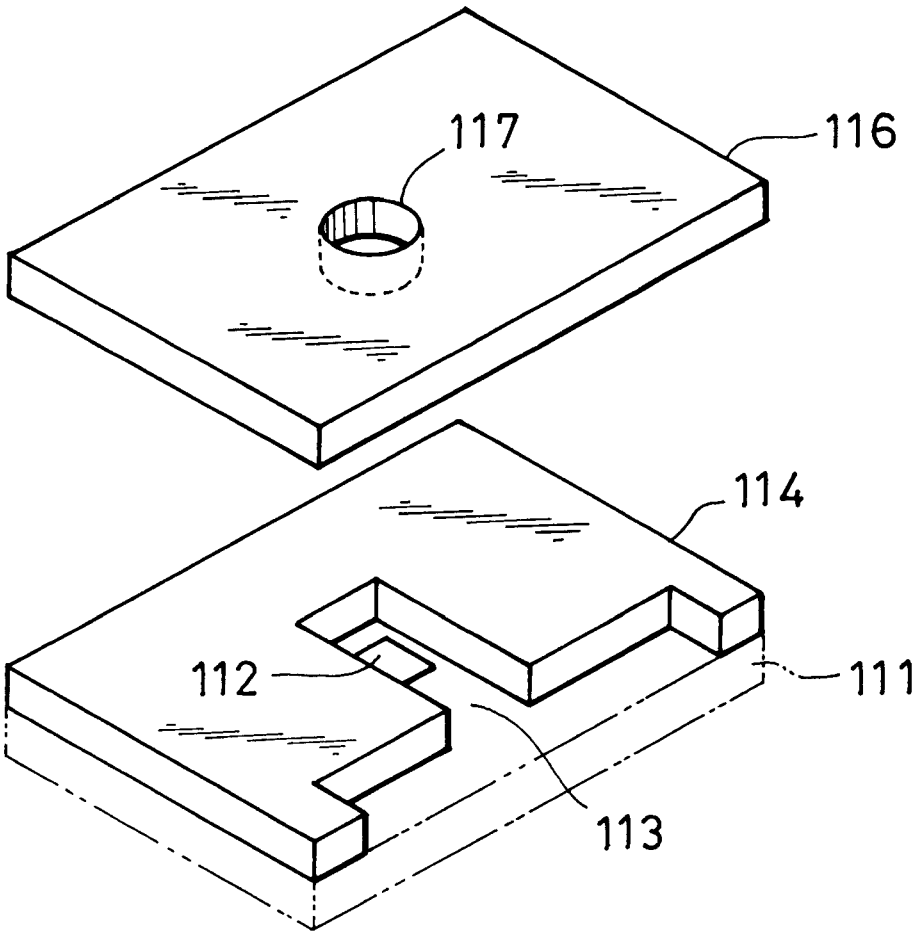
FIG. 12 is a schematic perspective view showing an example of the construction of the essential part of an ink jet head which is used in a second embodiment of the present invention and to which a bubble through ejection system is applicable.

FIG. 12 shows an example of the construction of a thermal ink jet printing head used in the second embodiment to which the bubble through ejection system is applicable. As shown in the drawing, on a substrate 111, there are formed a predetermined number of heaters 112 and electrode wiring (not shown) for transmitting electric signals to the heaters 112 and a partition 114 for defining liquid paths 113 at predetermined intervals on these heaters 112. A top plate 116 having an ink ejection outlet 117 is joined to the partition 114, whereby the thermal ink jet head is formed. That is, the portion surrounded by the partition 114, the substrate 111 and the top plate 116 constitutes the liquid path 113, and an ejection signal is applied to the heater 112 through the electrode wiring to generate a bubble on the heater 112, thereby ejecting a liquid droplet from an ejection outlet 115. Further, the substrate 111 has a built-in temperature sensor (not shown), and it is possible to monitor the temperature of the printing head through the output thereof.

Figure 13A:
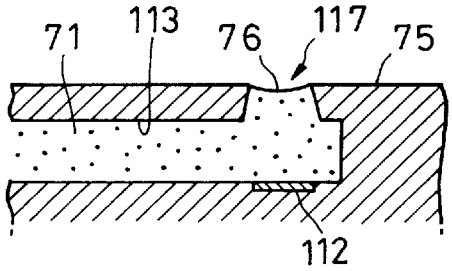
FIGS. 13A through 13F are diagrams illustrating an ejecting operation of the ink jet head shown in FIG. 12 according to the bubble through ejection system.
Figure 13B:
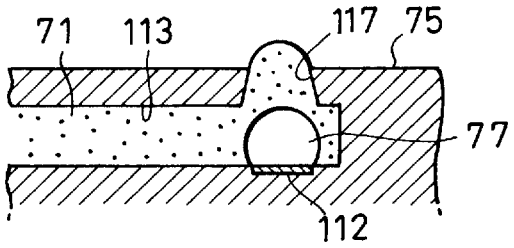
Figure 13C:
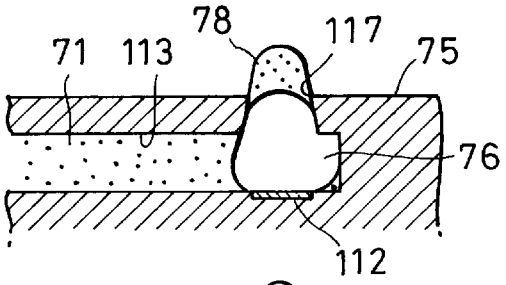
Figure 13D:
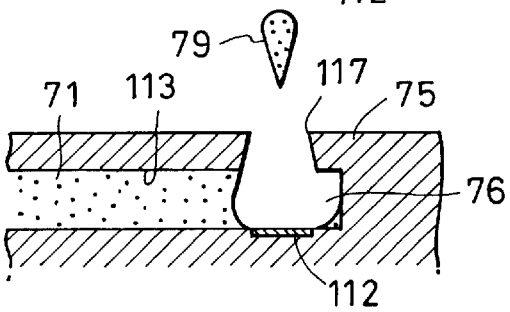
Figure 13E:
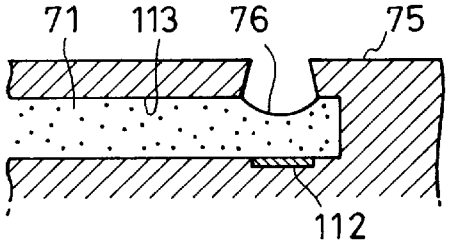
Figure 13F:
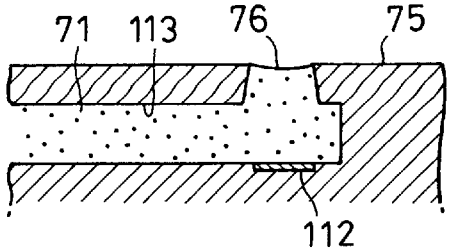

Next, in FIGS. 13A through 13F, numeral 71 indicates ink in the liquid path 113; numeral 75 indicates the ejection outlet surface; numeral 76 indicates the meniscus; and numeral 77 indicates the bubble. FIG. 13A shows the condition prior to the bubble generation, in which the meniscus 76 of the ink 71 is substantially in conformity with the ejection outlet surface 75. When the ink portion 71 near the heater 112 is heated by applying an ejection signal instantaneously to the heater 112, the bubble 77 is generated and starts to expand (FIG. 13B). The bubble 77 continues to expand, until it communicates with the atmospheric air through the ejection outlet 73 (FIGS. 13C and 13D). At this time, the ink portion 78 which has been on the side of the ejection outlet 117 with respect to the bubble 77 is pushed forward due to the momentum given from the bubble 77 up to this instant (FIG. 13C). Then, the ink portion 78 is ejected toward the printing medium such as paper as an independent droplet 79 (FIG. 13D). The meniscus 76 at this time is retracted inward from the ejection outlet 73, and a void is generated in front of it (FIG. 13E). However, this void is newly filled with ink due to the surface tension of the ink 71 and the wettability, etc. of the inner wall of the liquid path that is in contact with the ink, and the condition prior to the ejection is restored (FIG. 13F).

[Setting of Target Heating Temperature]

The setting of the target heating temperature is effected in a manner similar to that in the first embodiment. That is, at the start of the printing of each page, the ambient temperature is detected by a temperature sensor provided on the printing apparatus body to determine the target heating temperature. A table similar to that of FIG. 5 is used in this determination, and the value obtained is used until the start of the printing of each page, whereby it is possible to adapt the apparatus to the case in which the temperature in the printing apparatus rises and in which there is no need to effect the heat keeping of the printing head.

[Heat Keeping Control]

The heat keeping control in this embodiment is conducted with respect to the above-mentioned ΔT as in the first embodiment. In this embodiment, the driving of the ejection heater for heat keeping control is effected at a driving frequency, for example, of 40 kHz, and a driving pulse (short pulse) whose length is insufficient for causing the ink portion near the heater to boil is used.

As in the first embodiment, a short pulse as shown in FIG. 7 of a time interval corresponding to the above-mentioned ΔT is applied to the ejection heater prior to the printing start. The waveform of the driving pulse applied is the same as that in the first embodiment, which is shown in FIG. 8A. This heating, which is effected for the purpose of heating the ink portion near the heater and the component in which the heater is incorporated, is also performed for the purpose of heating a heat dissipating channel for dissipating the heat generated in the printing head, for example, the heat sink. In this way, heat keeping is effected, for example, before the printing scanning, whereby it is possible to delay the lowering of the temperature of the printing head whose temperature has been raised.

In this embodiment, the conditions for heat keeping are determined after the completion of the printing of one line, during the period in which the carriage with the printing head mounted thereon is moving toward the next printing start position or during the period in which the printing medium is fed. Specifically, the head temperature is detected when the printing of one line is completed, and the driving pulse for heat keeping control is determined in accordance with the calculated ΔT and the movement distance to the next line printing start position (hereinafter referred to as the "carriage movement distance"). The carriage movement distance can be obtained from the carriage position when the printing of one line is completed and the carriage position where the printing of the next line is started, which can be seen form the printing data.

Figure 14:
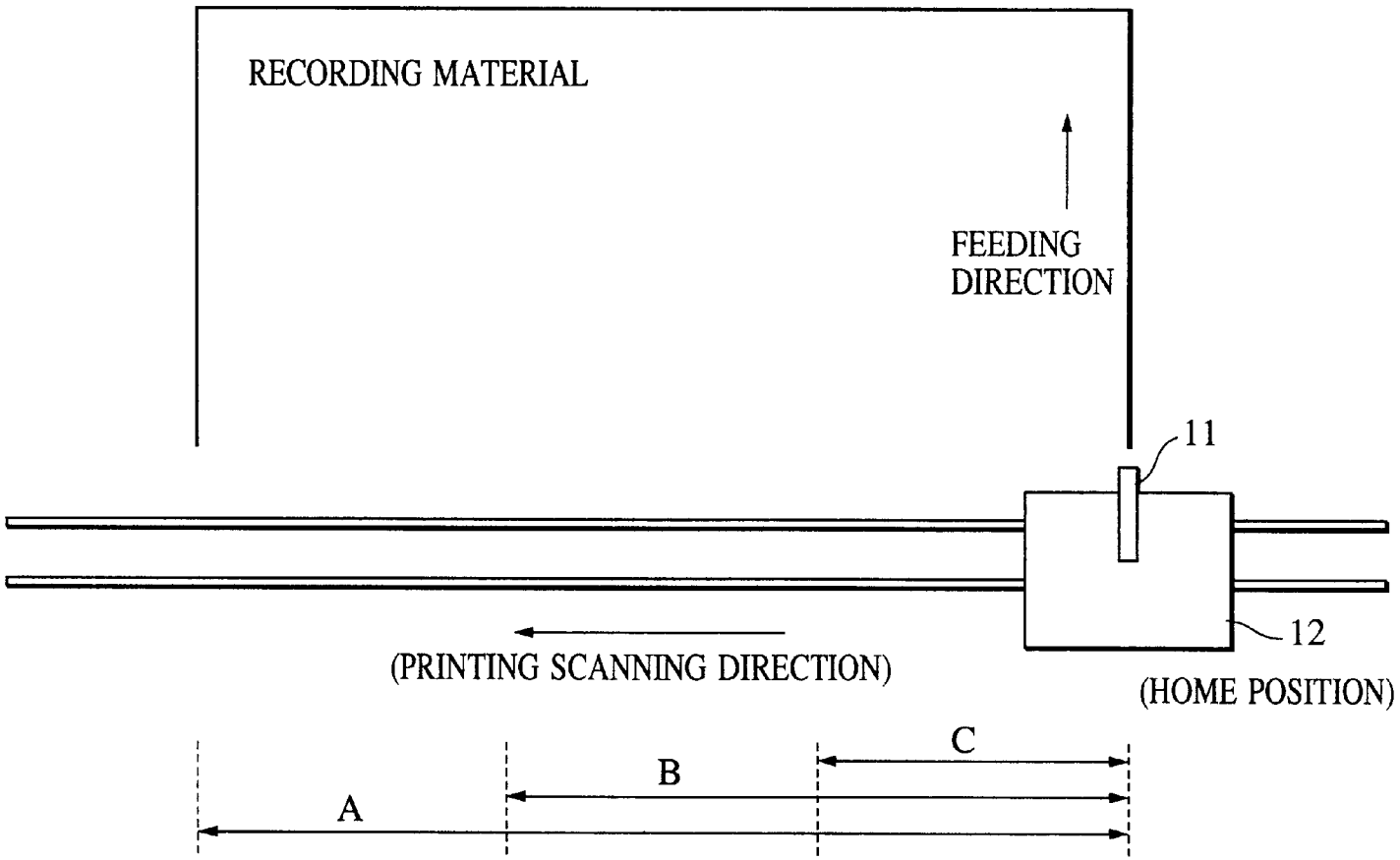
FIG. 14 is a schematic diagram for illustrating heat keeping control by carriage movement distance in the second embodiment.

FIG. 14 is a diagram for illustrating how control is effected in accordance with the carriage movement distance. In the printing operation of the printing apparatus in this embodiment, there is a margin on either side, for example, of one line of printing data; when the printing is performed only near the center, the scanning of one line is completed when the last ejecting operation for that line is completed, and the carriage with the printing head mounted thereon moves to the position where the printing of the next line is started. That is, in the margin, no scanning for printing is performed, and the carriage is moved to the next printing position at a speed higher than that at which it is moved while the printing scanning is conducted.

When printing is performed only in the middle portion of one line and there is a margin on either side thereof, the above-described carriage control is conducted in the printing apparatus of this embodiment, so that the period of time during which the printing head is in the non-printing state is reduced. Thus, the time for heat keeping control is reduced. In that case, it is quite desirable that high-duty heat keeping control be conducted even when ΔT is small (ΔT>0).

In view of this, as shown in FIG. 14, the size of the carriage movement range (movement amount) is divided into three ranks, A, B and C, and a table corresponding to the division is provided.

FIG. 15 shows an example of a table for determining the driving pulse. As to the driving pulse for heat keeping control, that shown in FIG. 8 with reference to the first embodiment is used.

Figure 16:
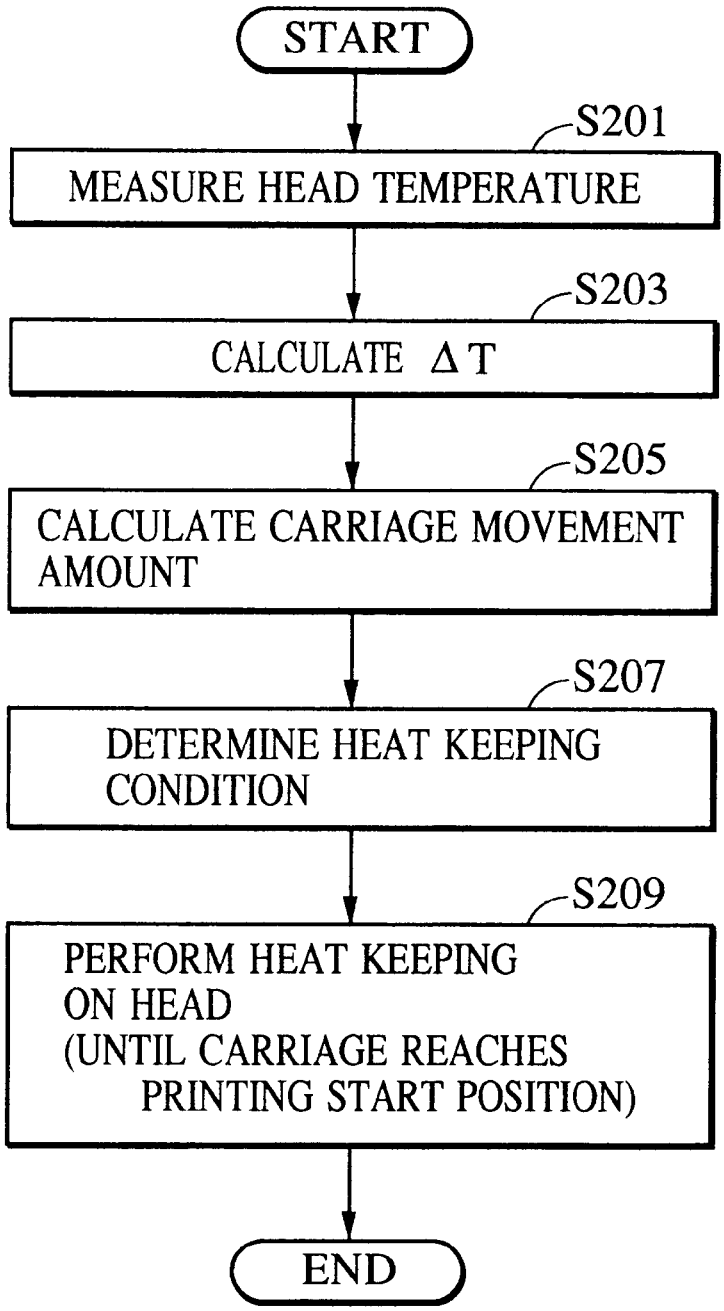
FIG. 16 is a flowchart showing an operational flow in heat keeping control in the second embodiment.

FIG. 16 shows an example of heat keeping control procedures to be executed after the completion of one scanning printing until the printing head reaches the next scanning printing start position. These procedures are started when the printing head is in the non-printing state after the completion of the printing of one line and while the carriage with the printing head mounted thereon is moving toward the next printing start position or while the printing medium is being fed. First, the head temperature is measured (Step S201), and, from the ΔT thereby calculated (Step S203) and the carriage movement distance or the movement distance rank calculated from the carriage position when the printing of one line is completed and the carriage position where the printing of the next line is started, which can be seen from the printing data (Step S205), the driving pulse waveform for heat keeping control is determined on the basis of the table of FIG. 15 (Step S207), executing heat keeping control until the carriage reaches the position where the printing of the next line is started.

By this control, it is possible to perform printing while maintaining the printing head at a temperature in a temperature range (which is not lower than 25° C. in this embodiment) which allows the printing head to operate in a highly reliable manner even when the print duty is low and there is little temperature rise as a result of the driving of the printing head for printing.

Further, since the information on the temperature of the printing head is obtained after the completion of the printing, it is possible to prevent the noise due to the printing from being mixed with the information on the temperature of the printing head, thereby making it possible to perform a highly accurate control.

In some cases, even when the printing head reaches the printing start position, printing cannot be started, as in the case in which the preparations for printing are not completed because of the host computer 1102 performing data transfer to the printing apparatus for the printing of the next line.

Figure 17:
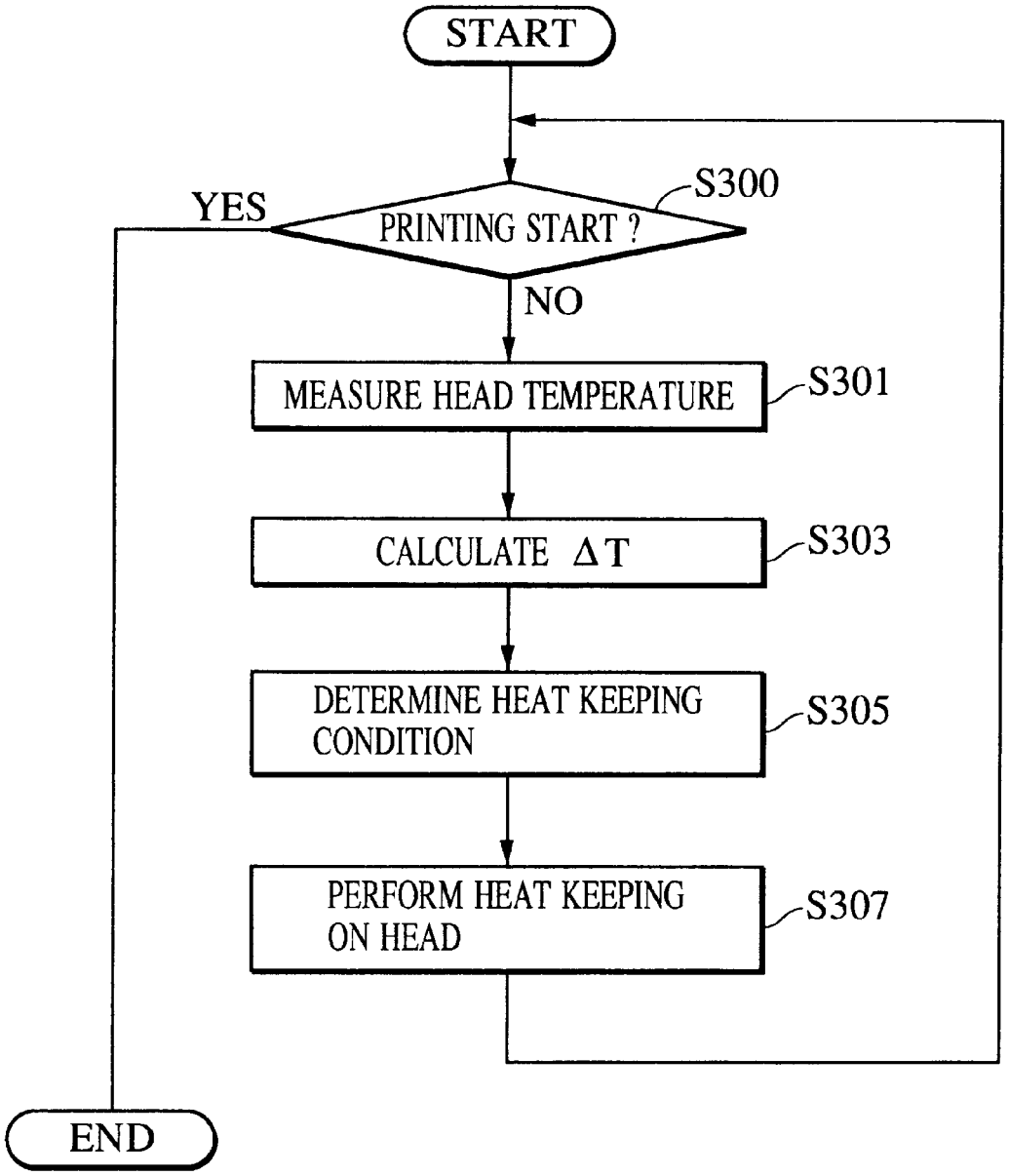
FIG. 17 is a flowchart showing an operational flow in heat keeping control in the second embodiment.

FIG. 17 is a flowchart showing an example of heat keeping control procedures to be executed in the case in which printing cannot be started even when the printing head has reached the position where the next scanning printing is to be started and the apparatus is on standby.

In these procedures, first, a judgment is made as to whether there is a printing start command signal or not (Step 100). When there is no printing start command, the above mentioned steps S201 through S209 and similar steps S303 through S307 are executed until, for example, 5 seconds have elapsed after the printing start position is reached. For the duty of the driving pulse determined in step S305, the value of the printing start position in FIG. 15 is used. The apparatus is held on standby for printing while continuing heat keeping control by applying the driving pulse of this duty to the ejection heater. This control is conducted for the purpose of maintaining the temperature of the printing head, which has been raised as a result of the heat keeping of the printing head in the non-printing period, and a pulse of a duty lower than that used in the flow of FIG. 16 is used. When the printing cannot be started even after the elapse of 5 seconds since the apparatus has been on standby for printing, the heat keeping for the printing head is stopped as in the first embodiment, and the carriage with the printing head mounted thereon is restored to the home position, where capping is performed.

In this embodiment, as in the first embodiment, the heat keeping for the printing head is effected by using the ejection heater, and only when the printing apparatus is in the non-printing state, whereby it is possible to realize a low-cost printing apparatus which is highly reliable even in a low-temperature environment or the like and which undergoes little variation in ejection amount during printing.

Further, in this embodiment, the heat keeping conditions are determined upon the completion of the printing of one line in accordance with the head temperature and the movement distance to the position where the printing of the next line is started. That is, while in the first embodiment the heat keeping conditions are calculated every 200 msec., in this embodiment, it is possible, due to this control, to reduce the operation time of the CPU spent on the heat keeping control to thereby reduce the burden on it, thereby increasing the time available for control operations other than the heat keeping for the printing head.

While in this embodiment the duty of the driving pulse for the ejection heater is determined as the heat keeping condition at the completion of the printing of one line, this should not be construed restrictively. It is also possible, for example, to determine as the heat keeping condition the period of time for which the heat keeping is effected on the printing head at the completion of the printing of one line. More specifically, it is possible to effect heat keeping solely by the above-mentioned short pulse of 40 kHz and determine the period of time for heat keeping by using a look-up table or the like in accordance with the ambient temperature, the printing head temperature and the period of time which allows heat keeping until the printing of the next line is started.

Third Embodiment

[Outline]

In the heat keeping control in the printing apparatus of the second embodiment, no scanning for printing is effected in the margins, the carriage being moved to the next printing position at a speed higher than that during the scanning for printing.

In the third embodiment of the present invention, printing is performed by main scanning in one direction, and the scanning by the carriage is ended when the scanning of the print portion has been completed, as in the second embodiment. In this embodiment, described below, control is effected so as to restore the carriage to a position near the home position before the scanning for the printing of each line is started.

The printing apparatus and the printing head used in this embodiment are the same as those in the second embodiment. Further, the setting of the above-mentioned target heating temperature is conducted in the same manner as in the first and second embodiments, effecting heat keeping control to maintain the printing heat at 25° C. Further, in this embodiment, the above-mentioned short pulse is applied to the ejection heater to effect heat keeping control. Further, as in the first embodiment, the ambient temperature is detected at the printing start by a temperature sensor similar to that in the first embodiment provided on the printing apparatus body to determine the target heating temperature.

In the heat keeping control of this embodiment, the application of a short pulse to the ejection heater for a predetermined period of time corresponding to a value obtained by subtracting the head temperature from the target heating temperature is effected before the page printing is started. In this embodiment, the condition for the heat keeping control until the position where the printing of the next line is started is reached is determined after the completion of the scanning for the printing of one line in accordance with the carriage position at that time and the ΔT calculated from the head temperature.

When the printing cannot be executed although the printing head is at the printing start position, which is the case, for example, when the host computer is transmitting printing data or when data is being developed, heat keeping control is effected with varied driving conditions until the printing is started. However, the heat keeping is stopped by the time 5 seconds have elapsed after the arrival of the printing head at the printing start position. When the printing is started again, heat keeping processing is first performed on the printing head as in the case of the starting of page printing.

[Heat Keeping Control]

In this embodiment, heat keeping control is effected with respect to ΔT. In this embodiment, the ejection heater for heat keeping control is driven, for example, at a driving frequency of 40 kHz and by the above-mentioned short pulse.

As in the first embodiment, a short pulse of a time interval corresponding to ΔT is applied to the ejection heater before the printing start shown in FIG. 7. The waveform of the driving pulse applied on that occasion is the same as that in the first embodiment, shown in FIG. 8A.

In this embodiment, the condition for heat keeping control to be conducted when the printing head is in the non-printing state and while the carriage with the printing head mounted thereon is moving toward the next printing start position or while the printing medium is being fed is determined after the completion of the printing of one line. Specifically, the head temperature is detected at the completion of the printing of one line, and a driving pulse for heat keeping control corresponding to the calculated ΔT and the position of the carriage when the print scanning has been completed (hereinafter referred to as the "carriage position") is determined.

Figure 18:
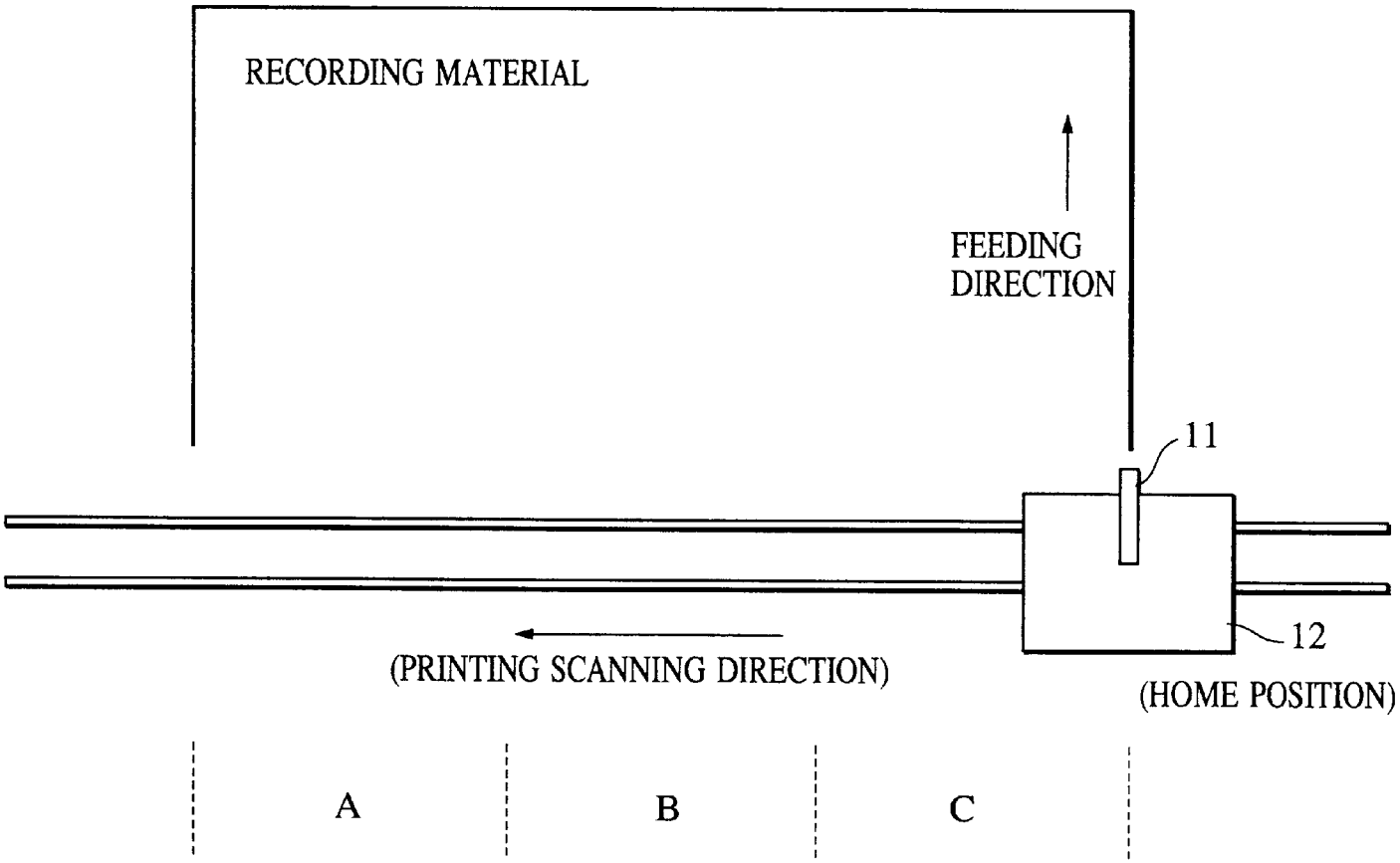
FIG. 18 is a schematic diagram for illustrating heat keeping control by carriage position in a third embodiment of the present invention.

With reference to FIG. 18, control by the above-mentioned carriage position will be explained. In this embodiment, as described above, printing is executed by main scanning in one direction. When the scanning of the print portion has been completed, the scanning by the carriage is stopped there, and control is effected so as to restore the carriage to a position near the home position before the scanning for the printing of each line is started, whereby it is possible, as needed, to perform preliminary ejection before each line printing. Due to this arrangement, it is possible to remove the ink portion near the ejection outlet of the printing head which has been particularly thickened as a result of the evaporation of the volatile ingredient, so that it is possible to effectively remove solely the ink portion having high viscosity. When the requisite time for each preliminary ejection is long, a reduction in throughput is caused, so that it is desirable for the preliminary ejection for each line to be short. In view of this, it is desirable, for example, to appropriately construct the means for preliminary ejection so that the preliminary ejection is executed while performing scanning by the printing head and the carriage.

When such carriage control is effected, the length of the non-printing period corresponds to the carriage position when the printing has been completed. Thus, in this embodiment, the driving condition for heat keeping control while the printing head is in the non-printing state is determined from the carriage position at the completion of the line printing and the above-mentioned ΔT calculated from the head temperature. For example, the condition for heat keeping control is selected according to which of the ranges A, B and C of FIG. 18 the carriage is in.

FIG. 19 shows an example of a table for selecting the condition for heat keeping control.

When printing cannot be started although the printing head has reached the printing start position as in the case in which data is being transferred from the computer to the printing apparatus for the printing of the next line and the print data has not been prepared yet, a processing similar to that in the second embodiment is executed. That is, the driving pulse duty corresponding to the printing start position in the table of FIG. 19 is applied to the ejection heater, and the apparatus is held on standby for printing while continuing the heat keeping of the printing head for 5 seconds at the maximum. This control is effected for the purpose of maintaining the temperature of the printing head which has been raised due to the heat keeping of the printing head in the non-printing state.

After this, the apparatus is brought into the printing standby state as in the first embodiment. When printing cannot be started even after 5 seconds have elapsed, the heat keeping of the printing head is stopped.

In this embodiment, as in the first and second embodiments, the heat keeping of the printing head is conducted by using the ejection heater and solely when the printing apparatus is in the non-printing state, printing being executed by the bubble through ejection method, whereby a low-cost printing apparatus is realized which is highly reliable in a low-temperature environment, etc. and which entails little variation in ejection amount during printing. Further, as compared with the second embodiment, the construction of this embodiment is advantageous in that it is only necessary to detect the carriage position during the period between the completion of the printing of one line and the starting of the printing of the next line.

While in the first through third embodiments the heat keeping of the printing head is effected by using the ejection heater and solely when the printing apparatus is in the non-printing state, printing being executed by the bubble through ejection method, it is possible to perform heat keeping control at a cost which is low to some degree without performing all of the above procedures. That is, it is possible to perform heat keeping control at low cost by adopting an arrangement in which the heat keeping of the printing head is effected by using the ejection heater and in which printing is executed by the bubble through ejection method, or an arrangement in which the heat keeping of the printing head is effected solely in the non-printing state and in which printing is executed by the bubble through ejection method.

If, when the printing head is in the state in which printing can be started, it is determined that the temperature of the printing head is low, control may be effected such that the apparatus is brought into the printing standby state to effect heat keeping.

Further, while in the printing apparatus used in the above embodiments the driving of the printing head for printing is effected by a single driving pulse, it is also possible to drive the printing head by a plurality of driving pulses. In that case, it is desirable that the ejection frequency be low enough to enable the printing head to be driven by a plurality of pulses.

Further, when the heat keeping of the printing head is effected in the non-printing state, the volatile ingredient of the ink is liable to evaporate through the ejection outlet, resulting in the concentration of the ink portion near the ejection outlet increasing. To cope with this problem, it is possible to perform preliminary ejection before the starting of the printing of each line, removing the ink portion whose concentration has been increased.

In the first through third embodiments, the ambient temperature is detected by using a sensor provided in the vicinity of the printing head in the printing apparatus, this should not be construed restrictively. The detection of the ambient temperature is performed for the purpose of determining the target heating temperature by making a judgment as to to what extent the printing head is to be heated before the starting of the printing in order that the temperature of the printing head may not become lower than a predetermined temperature during the print scanning of one line even when the print duty is low. This detection of the ambient temperature may also be effected by, for example, using an output value of a sensor for detecting the external temperature. However, when the temperature in the printing apparatus rises, the temperature of the printing head does not easily decrease, so that, even when the heat keeping is effected only to a small degree, the requisite reliability in printing can be secured. In this respect, performing heat keeping control by using the ambient temperature in the printing apparatus is more advantageous in that the control can be effected more effectively and efficiently. Further, it is also possible to provide a temperature sensor in the heat sink of the printing head and to make a judgment as to to what extent the printing head is to be heated (the setting of the target heating temperature) before the starting of the printing from the degree to which heat is dissipated to the exterior from the printing head.

While in the first through third embodiments described above a temperature sensor for detecting the ambient temperature is provided, it is also possible to obtain the requisite information by using a temperature sensor incorporated in the printing head to make a judgment as to to which extent the printing head is to be heated before the printing start to determine the target heating temperature in order that the temperature of the printing head may not become lower than a predetermined temperature during print scanning of one line even when the print duty is low. For example, the temperature of the printing head when the power source is turned on may be adopted as the ambient temperature. Further, it is also possible to perform preliminary ejection a predetermined number of times with a predetermined timing and to obtain information on the heat dissipated to the exterior from the printing head from the change in temperature on that occasion to thereby calculate the target heating temperature.

Further, while in the first through third embodiments the ambient temperature is measured before the starting of the printing of each page, this should not be construed restrictively. In a printing apparatus in which the temperature rise occurs rapidly, it is possible to measure the ambient temperature simultaneously with the measurement of the head temperature, for example, at the completion of the printing of each line. Further, if there is no need to effect heat keeping control effectively and efficiently, it is possible to perform measurement only once when the power source of the printing apparatus is turned on, effecting heat keeping control on the printing head using the value thus obtained.

Further, while in the first through third embodiments the temperature of the printing head is detected by using a temperature sensor incorporated in the printing head, this should not be construed restrictively. It is also possible to estimate the temperature of the printing head by performing calculation on the basis of the amount of imparted energy, as disclosed, for example, in Japanese Patent Laid-Open No. 5-208505 U.S. Application Ser. No. 07/921,832, filed Jul. 30, 1992, which has issued as U.S. Pat. Nos. 5,745,132, 5,751,304, 6,116,709, and 6,139,125. When such calculation for temperature estimation is adopted, the CPU requires a certain length of time for the calculation. However, this is advantageous in that the temperature sensor can be omitted, thereby achieving a reduction in cost.

Further, while the first through third embodiments have been described with reference to a printing apparatus in which the printing head is mounted on a carriage and in which image formation is conducted while effecting scanning with the carriage, this should not be construed restrictively. The present invention is also applicable, for example, to a printing apparatus which uses a so-called full-line head with ejection outlets aligned in a range corresponding to A4 width and which does not perform main scanning with the printing head, forming images solely by effecting the feeding of the printing medium. In this case, control is effected such that the printing head is heated by applying the above-mentioned short pulse to the ejection heater in order that the temperature of the printing head may not become lower than a fixed temperature during the printing of one page even when the print duty is low.

The present invention is particularly suitable for use in an ink jet recording head and recording apparatus wherein thermal energy generated by an electrothermal transducer, a laser beam or the like is used to cause a change of state of the ink to eject or discharge the ink. This is because the high density of the picture elements and the high resolution of the recording are possible.

The typical structure and the operational principle of such devices are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure waves of the thermal energy is formed corresponding to the ejecting portion. This is because the present invention is effective to perform the recording operation with certainty and at high efficiency regardless of the type of recording head.

In addition, the present invention is applicable to a serial type recording head wherein the recording head is fixed on the main assembly, to a replaceable chip type recording head which is connected electrically with the main apparatus and which can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. Examples of such means include a capping means for the recording head, cleaning means therefore, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single head corresponding to a single color ink, or may be plural heads corresponding to the plurality of ink materials having different recording colors or densities. The present invention is effectively applied to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiments, the ink has been liquid. It also may be ink material which is solid below the room temperature but liquid at room temperature. Since the ink is kept within a temperature between 30° C. and 70° C., in order to stabilize the viscosity of the ink to provide the stabilized ejection in the usual recording apparatus of this type, the ink may be such that it is liquid within the temperature range when the recording signal is the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, in response to the application of the recording signal producing thermal energy, the ink is liquefied, and the liquefied ink may be ejected. Another ink material may start to be solidified at the time when it reaches the recording material.

The present invention is also applicable to such, an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one of the techniques described above is the film boiling system.

The ink jet recording apparatus may be used as and output terminal of an information processing apparatus such as computer or the like, as a copying apparatus combined with an image reader or the like, or as a facsimile machine having information sending and receiving functions.

While the invention has been described with reference to the structures disclosed herein, it is not confined to the details set forth and this application is intended to cover such modifications or changes as may come within the purposes of the improve-ments or the scope of the following claims.

What is claimed is:

1. An ink jet printing apparatus which receives a driving signal from a driving signal source, comprising:

an ink jet head in which the driving signal is supplied to energy generating means arranged in a liquid path to supply heat energy generated by said energy generating means to ink to thereby form a bubble therein and in which said bubble communicates with the atmospheric air and ink is ejected from an ejection outlet to thereby effect printing; and control means for controlling heat keeping on said ink jet head by supplying said energy generating means with the heating signal to generate an amount of heat energy that is not enough to cause ink to be ejected, wherein said control means does not control heat keeping on said ink jet head during a predetermined continuous printing, and controls said heat keeping before printing operation is started so that said ink jet head is maintained at a temperature not lower than a predetermined temperature during printing.

2. An ink jet printing apparatus according to claim 1, wherein, apart from said energy generating means, there is provided no other means for controlling heat keeping on said ink jet head.

3. An ink jet printing apparatus according to claim 1, wherein said ink jet head performs main scanning in predetermined directions with respect to the printing medium, and wherein printing operation is executed during main scanning in one of said directions.

4. An ink jet printing apparatus according to claim 1, wherein said ink jet head performs main scanning in a predetermined direction with respect to the printing medium, and wherein said control means does not control said heat keeping in said main scanning for printing as said predetermined continuous printing operation, and controls said heat keeping before said main scanning is started.

5. An ink jet printing apparatus according to claim 1, wherein said control means detects or estimates the amount of heat leaking from said ink jet head to the exterior, and determines a heat keeping condition for said heat keeping on the basis of the information thus obtained.

6. An ink jet printing apparatus according to claim 5, wherein said control means detects said amount of heat by using at least the difference between the temperature of said ink jet head and the temperature outside said ink jet head to thereby determine said heat keeping condition.

7. An ink jet printing apparatus according to claim 5, wherein said control means obtains temperature information on said ink jet head at the completion of a predetermined continuous printing operation, and determines said heat keeping condition by using at least this information to control said heat keeping.

8. An ink jet printing apparatus according to claim 7, wherein said control means determines said heat keeping condition at predetermined periods to control said heat keeping.

9. An ink jet printing apparatus according to claim 8, wherein said control means determines said heat keeping condition and controls said heat keeping after the completion of a predetermined continuous printing operation until the next printing operation is started.

10. An ink jet printing apparatus according to claim 9, wherein said control means determines said heat keeping condition and controls said heat keeping by using at least the temperature information on said ink jet head, the external temperature information, and information on the period of time required until the next printing is started.

11. An ink jet printing apparatus according to claim 10, wherein said information on the period of time corresponds to information on the position of said ink jet head with respect to said printing medium at the completion of said predetermined continuous printing operation and at the start of the next printing operation.

12. An ink jet printing apparatus according to claim 10, wherein, when printing operation cannot be started although said ink jet head is at the position where the next printing operation is to be started, said control means determines said heat keeping condition by using the temperature information on said ink jet head and the information on the external temperature and controls said heat keeping while being on standby for the starting of printing operation for a predetermined period of time.

13. An ink jet printing apparatus according to claim 5, wherein, when said ink jet head does not satisfy a predetermined temperature condition although said ink jet head is at the position where the next printing operation is to be started, said control means controls said heat keeping while being on standby for the starting of printing operation.

14. An ink jet printing apparatus which receives a driving signal from a driving signal source, comprising:

an ink jet printing head in which the driving signal is supplied to energy generating means arranged in a liquid path to supply heat energy generated by said energy generating means to ink to thereby form a bubble therein and in which said bubble communicates with the atmospheric air and ink is ejected from an ejection outlet to thereby effect printing;

heat keeping means for keeping said printing head warm; and control means which does not control said heat keeping means during a predetermined continuous printing operation and which controls said heat keeping means before the starting of a printing operation such that said ink jet printing head is kept at a temperature not lower than a predetermined temperature during the printing operation.

15. An ink jet printing apparatus according to claim 14, wherein said ink jet head performs main scanning in a predetermined direction with respect to the printing medium, and wherein said control means does not control said heat keeping means in said main scanning for printing as said predetermined continuous printing operation, and control said heat keeping means before said main scanning is started.

16. An ink jet printing apparatus according to claim 14, wherein said heat keeping means supplies said heat energy generating means with a heating signal which generates an amount of heat energy insufficient for causing ink to be ejected.

17. An ink jet printing apparatus according to claim 14, wherein said ink jet head performs main scanning in a predetermined direction with respect to the printing medium, and wherein said control means does not perform said heat keeping in said main scanning for printing as said predetermined continuous printing operation, and controls said heat keeping before said main scanning is started.

18. An ink jet printing apparatus according to claim 14, wherein said control means detects or estimates the amount of heat leaking from said ink jet head to the exterior, and determines a heat keeping condition for said heat keeping based on the information thus obtained.

19. An ink jet printing apparatus according to claim 18, wherein said control means detects said amount of heat by using at least the difference between the temperature of said ink jet head and the temperature outside said ink jet head to thereby determine said heat keeping condition.

20. An ink jet printing apparatus according to claim 18, wherein said control means obtains temperature information on said ink jet head at the completion of a predetermined continuous printing operation, and determines said heat keeping condition by using at least this information to control said heat keeping.

21. An ink jet printing apparatus according to claim 20, wherein said control means determines said heat keeping condition at predetermined periods to control said heat keeping.

22. An ink jet printing apparatus according to claim 21, wherein said control means determines said heat keeping condition and controls said heat keeping after the completion of a predetermined continuous printing operation until the next printing operation is started.

23. An ink jet printing apparatus according to claim 22, wherein said control means determines said heat keeping condition and controls said heat keeping by using at least the temperature information on said ink jet head, the external temperature information, and information on the period of time required until the next printing is started.

24. An ink jet printing apparatus according to claim 23, wherein said information on the period of time corresponds to information on the position of said ink jet head with respect to said printing medium at the completion of said predetermined continuous printing operation and at the start of the next printing operation.

25. An ink jet printing apparatus according to claim 23, wherein, when printing operation cannot be started although said ink jet head is at the position where the next printing operation is to be started, said control means determines said heat keeping condition by using the temperature information on said ink jet head and the information on the external temperature and controls said heat keeping while being on standby for the starting of printing operation for a predetermined period of time.

26. An ink jet printing apparatus according to claim 18, wherein, when said ink jet head does not satisfy a predetermined temperature condition although said ink jet head is at the position where the next printing operation is to be started, said control means controls said heat keeping while being on standby for the starting of printing operation.

27. A heat keeping control method for an ink jet head which receives a driving signal from a driving signal source, comprising the steps of:

providing an ink jet head in which the driving signal is supplied to energy generating means arranged in a liquid path to supply heat energy generated by said energy generating means to ink to thereby form a bubble therein and in which said bubble communicates with the atmospheric air and ink is ejected from an ejection outlet to thereby effect printing; and supplying said energy generating means with a heating signal to generate heat energy in an amount not enough to cause ink to be ejected to thereby effect heat keeping control on said ink jet printing head, and not controlling heat keeping on said ink jet head during a predetermined continuous printing, and controlling said heat keeping before a printing operation is started so that said ink jet head is maintained at a temperature not lower than a predetermined temperature during printing.

28. A heat keeping control method for an ink jet head which receives a driving signal from a driving signal source, comprising the steps of:

providing an ink jet head in which the driving signal is supplied to energy generating means arranged in a liquid path to supply heat energy generated by said energy generating means to ink to thereby form a bubble therein and in which said bubble communicates with the atmospheric air and ink is ejected from an ejection outlet to thereby effect printing;

providing heat keeping means for keeping said printing head warm; and suspending the control of said heat keeping means during a predetermined continuous printing operation and controlling said heat keeping means before the starting of a printing operation so that said ink jet printing head is kept at a temperature not lower than a predetermined temperature during the printing operation.

29. A heat keeping control method for an ink jet head according to claim 28, wherein said heat keeping means supplies said heat energy generating means with a heating signal which generates heat energy in an amount not enough to cause ink to be ejected.

* * * * *